US008375573B2

(12) United States Patent
Daitou et al.

(10) Patent No.: US 8,375,573 B2
(45) Date of Patent: Feb. 19, 2013

(54) FORMING APPARATUS AND FORMING METHOD OF WIRE JOINT PORTION

(75) Inventors: Kouji Daitou, Makinohara (JP); Mikitsugu Suzuki, Makinohara (JP); Kenji Tanaka, Susono (JP); Noriyuki Fukaya, Susono (JP); Tetsuro Ide, Susono (JP)

(73) Assignee: Yazaki Corporation, Tokyo (JP)

( * ) Notice: Subject to any disclaimer, the term of this patent is extended or adjusted under 35 U.S.C. 154(b) by 69 days.

(21) Appl. No.: 13/133,417

(22) PCT Filed: Dec. 25, 2009

(86) PCT No.: PCT/JP2009/071910

§ 371 (c)(1),
(2), (4) Date: Jun. 8, 2011

(87) PCT Pub. No.: WO2010/074349

PCT Pub. Date: Jul. 1, 2010

(65) Prior Publication Data

US 2011/0232083 A1 Sep. 29, 2011

(30) Foreign Application Priority Data

Dec. 26, 2008 (JP) ..... 2008-333064
May 22, 2009 (JP) ..... 2009-124257

(51) Int. Cl.
*H01R 43/00* (2006.01)
*B23P 19/04* (2006.01)

(52) U.S. Cl. ..... 29/825; 29/33.5; 29/778; 29/779

(58) Field of Classification Search ..... 29/728, 29/779, 33.5, 825
See application file for complete search history.

(56) References Cited

U.S. PATENT DOCUMENTS 3,224,851 A * 12/1965 Hicks, Jr. ..... 65/409
4,127,398 A * 11/1978 Singer, Jr. ..... 65/393
4,310,607 A * 1/1982 Shay ..... 429/104
2009/0218134 A1 9/2009 Stroh et al.

FOREIGN PATENT DOCUMENTS

CA 838850 A 4/1970
DE 10 2006 021 422 A1 11/2007
JP 4-33287 A 2/1992
JP 2008-86169 A 4/2008

OTHER PUBLICATIONS

International Search Report (PCT/ISA/210) dated May 3, 2010, in PCT/JP2009/071910.

* cited by examiner

*Primary Examiner* — Carl Arbes
(74) *Attorney, Agent, or Firm* — Sughrue Mion, PLLC

(57) ABSTRACT

A forming apparatus for forming a wire joint portion including a connection portion and an insulative tube covering the connection portion is provided. The forming apparatus includes: a production information acquiring unit which acquires production information; a connection portion forming unit which fixes a plurality of wires selected on the basis of the production information, and then electrically connects conductor portions of the wires together to form the connection portion; a first fusing unit which fuses one open end portion of the insulative tube to close the one open end portion; an inserting unit which moves the wires so as to insert the connection portion into the insulative tube through the other open end portion of the insulative tube; a second fusing unit which fuses the other open end portion of the insulative tube and insulative sheaths of the wires together so as to form the wire joint portion.

11 Claims, 14 Drawing Sheets

FORMING APPARATUS AND FORMING METHOD OF WIRE JOINT PORTION

TECHNICAL FIELD

This invention relates to an apparatus for and a method of forming a wire joint portion including a connection portion and an insulative tube covering the connection portion, the connection portion being formed by electrically connecting conductor portions of end portions of a plurality of wires together.

BACKGROUND ART

For example, when installing a wire harness, insulative sheaths have been removed from end portions of a plurality of wires, and exposed portions of conductor portions of the wires have been electrically connected together to form a connection portion. In order to ensure an electrical insulation of this connection portion, an insulative tube made of an electrically-insulative material has been used.

FIGS. 24 to 26 show a conventional insulative tube of this kind disclosed in Patent Literature 1. FIG. 24 is a plan view of the conventional insulative tube. FIG. 25 is a plan view showing the manner of inserting a connection portion of a plurality of wires into the insulative tube of FIG. 24. FIG. 26 is a plan view showing a condition in which the connection portion of the plurality of wires is inserted in the insulative tube of FIG. 24, and the insulative tube is fixed to the plurality of wires by an adhesive tape.

The insulative tube 100 shown in FIG. 24 includes a cylindrical tube body 102 which has one end portion 103 sealed by a fusing treatment and is open at the other end portion 105, and a tongue portion 104 extending from the other end portion 105 of the tube body 102.

The plurality of wires 101 shown in FIG. 25 are well-known sheathed wires, and insulative sheaths are removed or stripped respectively from end portions of the plurality of wires 101, so that conductor portions are exposed at the end portions of the wires. The exposed portions of the conductor portions are electrically connected together to form the connection portion 110.

For covering the connection portion 110 of the plurality of wires 101 with the insulative tube 100 so as to form "a wire joint portion 106" mentioned above, the connection portion 100 of the plurality of wires 101 is inserted into a predetermined position within the tube body 102 through the other end portion 105 thereof as shown in FIG. 25, and then the tongue portion 104 and the plurality of wires 101 are fastened together by the adhesive tape 111 as shown in FIG. 26.

Citation List

Patent Literature

[PTL 1] JP-A-2008-86169

SUMMARY OF INVENTION

Technical Problem

However, the following problems have been encountered in the method of forming the wire joint portion 106 by the use of the above conventional insulative tube 100. Namely, the operation for fastening the tongue portion 104 and the plurality of wires 101 together by the adhesive tape 111 could not be easily automated by the use of a machine, and this fastening operation has been carried out manually. Therefore, there has been encountered a problem that the productivity is low.

In addition, the operation for inserting the connection portion 110 of the plurality of wires 101 into the predetermined position within the tube body 102 has been carried out manually. The worker has conducted this operation while confirming the amount of insertion of the connection portion 110 into the tube body 102 with the eyes, and the worker must be attentive to this operation, which has invited a problem that the productivity is low.

In order to enhance the above productivity, it may be proposed to fuse (or fusedly bond) the tongue portion 104 and the insulative sheaths of the plurality of wires 101 together by a machine instead of fastening the tongue portion 104 and the plurality of wires 101 together by the adhesive tape 111. As another alternative, it may be proposed to fuse the other end portion 105 of the tube body 102 and the insulative sheaths of the plurality of wires 101 together by a machine. However, in case the insulative tube 100 thus fused to the plurality of wires 101 by the machine is separated from the plurality of wires 101, it has been difficult to again fuse the insulative tube 100 to the plurality of wires 101. Furthermore, there has been a fear that defective products having the insufficiently-fused portion might be included in shipped products. Therefore, in the case of fusing the insulative tube 100 and the plurality of wires 101 together by the machine, it has been necessary to ensure a sufficient strength of fixing of the insulative tube 100 and the plurality of wires 101 to each other.

Solution to Problem

Therefore, it is an object of this invention to provide a forming apparatus and a forming method of a wire joint portion, in which a wire joint portion can be formed in an automated manner while securing an excellent productivity.

In order to achieve the object, in a first aspect there is provided a forming apparatus for forming a wire joint portion including a connection portion and an insulative tube covering the connection portion, the forming apparatus including: a production information acquiring unit which acquires production information indicating part numbers of wires and the insulative tube; a connection portion forming unit which fixes a plurality of supplied wires selected on the basis of the production information, and then electrically connects conductor portions of the wires together to form the connection portion; a tube feeding/cutting unit which feeds an elongated insulative tube, selected and supplied on the basis of the production information in a predetermined amount, and then cuts the elongated insulative tube into a predetermined length to provide the insulative tube in a cut-off condition; a first fusing unit which fuses one open end portion of the insulative tube to close the one open end portion; an inserting unit which moves the plurality of wires so as to insert the connection portion into a predetermined position within the insulative tube through the other open end portion of the insulative tube; a second fusing unit which fuses the other open end portion of the insulative tube and insulative sheaths of the plurality of wires together so as to form the wire joint portion; and a discharging unit which discharges the plurality of wires having the wire joint portion formed thereat.

The forming apparatus in a second aspect may be configured so that the production information indicates a product-producing number representative of the number of the wire joint portions to be formed, and the forming apparatus includes a control unit which causes the connection portion forming unit, the tube feeding/cutting unit, the first fusing unit, the inserting unit, the second fusing unit and the discharging unit to be repeatedly operated on the basis of the product-producing number.

The forming apparatus in a third aspect may include an insertion guide which is located at a position to be facing the other open end portion of the insulative tube having the one open end portion fused by the first fusing unit, the insertion guide including a through hole having inner diameter gradually decreasing from one end thereof remote from the other open end portion of the insulative tube toward the other end thereof facing the other open end portion of the insulative tube, so as to pass the connection portion formed by the connection portion forming unit through the through hole from the one end of the through hole to the other end so that the connection portion is guided toward the other open end portion of the insulative tube by the insertion guide.

The forming apparatus in a fourth aspect may include: an air injection unit which blows air against a fused portion formed by fusing the other open end portion of the insulative tube and the insulative sheaths of the plurality of wires together by the second fusing unit, for a predetermined period of time; and a pulling unit which includes: a pair of chucks for respectively gripping the plurality of wires and the insulative tube after finishing blowing of the air by the air injection unit; and a load applying portion which applies a predetermined load to at least one of the pair of chucks so as to pull the one chuck in a direction away from the other chuck.

The forming apparatus in a fifth aspect may be configured so that the connection portion forming unit includes: a pair of orderly-arranging guides which are opposed to each other in a horizontal direction and spaced from each other by a predetermined distance corresponding to a diameter of the wires so as to hold the plurality of wires therebetween to thereby arrange the plurality of wires in a column in a vertical direction; and a connecting machine which electrically connects the conductor portions of the plurality of wires, arranged in the column by the pair of orderly-arranging guides, together to form the connection portion, that the second fusing unit includes a pair of fusing members for holding the other open end portion of the insulative tube therebetween so as to fuse the other open end portion and the insulative sheaths of the plurality of wires together, and that the inserting unit arranges the plurality of wires in a row in a direction perpendicular to a direction along which the pair of fusing members are opposed to each other to hold the insulative tube therebetween, and inserts the connection portion of the plurality of wires into the insulative tube.

The forming apparatus in a sixth aspect may include a distal end correction unit which corrects the connection portion in a misaligned condition into a straight condition before the connection portion is inserted into the insulative tube.

In a seventh aspect there is provided a forming method of forming a wire joint portion including a connection portion and an insulative tube covering the connection portion, the forming method including: a production information acquiring step of acquiring production information indicating part numbers of wires and the insulative tube; a connection portion forming step of fixing a plurality of supplied wires selected on the basis of the production information and then electrically connecting conductor portions of the wires together to form the connection portion; a tube setting step of setting an elongated insulative tube, having the part number indicated in the production information, in a tube feeding/cutting unit; a tube feeding/cutting step of feeding the elongated insulative tube in a predetermined amount and then cutting the elongated insulative tube into a predetermined length by the use of the tube feeding/cutting unit to thereby provide the insulative tube in a cut-off condition; a first fusing step of fusing one open end portion of the insulative tube to close the one open end portion; an inserting step of moving the plurality of wires so as to insert the connection portion into a predetermined position within the insulative tube through the other open end portion of the insulative tube; a second fusing step of fusing the other open end portion of the insulative tube and insulative sheaths of the plurality of wires together so as to form the wire joint portion; and a discharging step of discharging the plurality of wires having the wire joint portion formed thereat.

The forming method in an eighth aspect may be configured so that an insertion guide is used in the inserting step, and the insertion guide is located at a position to be facing the other open end portion of the insulative tube having the one open end portion fused in the first fusing step, the insertion guide including a through hole having inner diameter gradually decreasing from one end thereof remote from the other open end portion of the insulative tube toward the other end thereof facing the other open end portion of the insulative tube, so as to pass the connection portion formed in the connection portion forming step through the through hole of the insertion guide from the one end of the through hole to the other end so that the connection portion is guided toward the other open end portion of the insulative tube by the insertion guide.

The forming method in a ninth aspect may include: an air injection step of blowing air against a fused portion, formed by fusing the other open end portion of the insulative tube and the insulative sheaths of the plurality of wires together in the second fusing step, for a predetermined period of time; and a pulling step of gripping the plurality of wires and the insulative tube after the air injection step, and then pulling the plurality of wires and the insulative tube under a predetermined load relative to each other.

The forming method in a tenth aspect may be configured so that in the connection portion forming step, there are used a pair of orderly-arranging guides which are opposed to each other in a horizontal direction and spaced from each other by a predetermined distance corresponding to a diameter of the wire so as to hold the plurality of wires therebetween to thereby arrange the plurality of wires in a column in a vertical direction, and the conductor portions of the plurality of wires arranged in the column by the pair of orderly-arranging guides are electrically connected together to form the connection portion; that in the second fusing step, there are used a pair of fusing members for holding the other open end portion of the insulative tube therebetween so as to fuse the other open end portion and the insulative sheaths of the plurality of wires together; and that in the inserting step, the plurality of wires are arranged in a row in a direction perpendicular to a direction along which the pair of fusing members are opposed to each other to hold the insulative tube therebetween, and the connection portion of the plurality of wires is inserted into the insulative tube.

The forming method in an eleventh aspect may include a distal end correction step of correcting the connection portion in a misaligned condition into a straight condition before the inserting step.

The forming apparatus of the first aspect includes the production information acquiring unit which acquires the production information indicating the part numbers of the wires and the insulative tube, the connection portion forming unit which fixes the plurality of supplied wires selected on the basis of the production information and then electrically connects the conductor portions of the wires together to form the connection portion, the tube feeding/cutting unit which feeds the elongated insulative tube, selected on the basis of the production information and supplied thereto, in the predetermined amount and cuts the elongated insulative tube into the predetermined length to provide the insulative tube in the cut-off condition, the first fusing unit which fuses the one open end portion of the insulative tube to close the one open end portion, the inserting unit which moves the plurality of wires so as to insert the connection portion into the predetermined position within the insulative tube through the other open end portion of the insulative tube, and the second fusing unit which fuses the other open end portion of the insulative tube and the insulative sheaths of the plurality of wires together so as to form the wire joint portion, and the discharging unit which discharges the plurality of wires having the wire joint portion formed thereat. Therefore, the operation for forming the wire joint portion which has heretofore been manually carried out can be automated, and the productivity can be enhanced.

In the second aspect, the production information indicates the product-producing number representative of the number of the wire joint portions to be formed, and there is provided the control unit which causes the connection portion forming unit, the tube feeding/cutting unit, the first fusing unit, the inserting unit, the second fusing unit and the discharging unit to be repeatedly operated on the basis of the product-producing number. Therefore, the productivity can be further enhanced.

In the third aspect, there is provided the insertion guide which is located at a position to be facing the other open end portion of the insulative tube having the one open end portion fused by the first fusing unit, the insertion guide including a through hole having inner diameter gradually decreasing from one end thereof remote from the other open end portion of the insulative tube toward the other end thereof facing the other open end portion of the insulative tube, so as to pass the connection portion formed by the connection portion forming unit through the through hole from the one end of the through hole to the other end so that the connection portion is guided toward the other open end portion of the insulative tube by the insertion guide. Therefore, the connection portion can be positively inserted into the insulative tube, and the productivity can be further enhanced. And besides, the connection portion is prevented from striking against the other open end portion (that is, the other end) of the insulative tube, thus preventing the insulative tube from being damaged.

In the fourth aspect, there is provided the air injection unit which blows the air against the fused portion, formed by fusing the other open end portion of the insulative tube and the insulative sheaths of the plurality of wires together by the second fusing unit, for the predetermined period of time, and there is provided the pulling unit including the pair of chucks for respectively gripping the plurality of wires and the insulative tube after finishing the blowing of the air by the air injection unit, and the load applying portion which applies the predetermined load to at least one of the pair of chucks so as to pull the one chuck in the direction away from the other chuck. Therefore, with the simple equipment associated with the facilities for forming the wire joint portion, a check for checking whether or not the strength of fixing of the insulative tube and the plurality of wires to each other is sufficient can be carried out in continuous relation to the wire joint portion forming operation.

In the fifth aspect, the connection portion forming unit includes the pair of orderly-arranging guides which are opposed to each other in the horizontal direction and spaced from each other by the predetermined distance corresponding to the diameter of the wire so as to hold the plurality of wires therebetween to thereby arrange the plurality of wires in the column in the vertical direction, and includes the connecting machine which electrically connects the conductor portions of the plurality of wires, arranged in the column by the pair of orderly-arranging guides, together to form the connection portion. Therefore, the plurality of wires can be easily arranged in the column, and also the quality of the connection portion can be enhanced, and besides the quality of the connection portion can be made stable. Furthermore, the inserting unit arranges the plurality of wires in the row in the direction perpendicular to the direction along which the pair of fusing members are opposed to each other to hold the insulative tube therebetween, and inserts the connection portion of the plurality of wires into the insulative tube. Therefore, the fused portion formed by fusing the other open end portion of the insulative tube and the insulative sheaths of the plurality of wires together by the pair of fusing members can have a predetermined area, and the quality of the fused portion can be enhanced, and also the quality of the fused portion can be made stable.

In the sixth aspect, there is provided the distal end correction unit which corrects the connection portion in a misaligned condition into a straight condition before the connection portion is inserted into the insulative tube. Therefore, the connection portion corrected into the straight condition can be positively inserted into the insulative tube, and the processing efficiency can be enhanced.

The forming method in the seventh aspect includes: the production information acquiring step of acquiring the production information indicating the part numbers of the wires and the insulative tube; the connection portion forming step of fixing the plurality of supplied wires selected on the basis of the production information and then electrically connecting the conductor portions of the wires together to form the connection portion; the tube setting step of setting the elongated insulative tube, having the part number indicated in the production information, in the tube feeding/cutting unit; the tube feeding/cutting step of feeding the elongated insulative tube in the predetermined amount and then cutting the elongated insulative tube into the predetermined length by the use of the tube feeding/cutting unit to thereby provide the insulative tube in the cut-off condition; the first fusing step of fusing the one open end portion of the insulative tube to close the one open end portion; the inserting step of moving the plurality of wires so as to insert the connection portion into the predetermined position within the insulative tube through the other open end portion of the insulative tube; the second fusing step of fusing the other open end portion of the insulative tube and the insulative sheaths of the plurality of wires together so as to form the wire joint portion; and the discharging step of discharging the plurality of wires having the wire joint portion formed thereat. Therefore, the operation for forming the wire joint portion which has heretofore been manually carried out can be automated using machines, and the productivity can be enhanced.

In the eighth aspect, the insertion guide is used in the inserting step, and the insertion guide is located at a position to be facing the other open end portion of the insulative tube having the one open end portion fused in the first fusing step, the insertion guide including a through hole having inner diameter gradually decreasing from one end thereof remote from the other open end portion of the insulative tube toward the other end thereof facing the other open end portion of the insulative tube, so as to pass the connection portion formed in the connection portion forming step through the through hole of the insertion guide from the one end of the through hole to the other end so that the connection portion is guided toward the other open end portion of the insulative tube by the insertion guide. Therefore, the connection portion can be positively inserted into the insulative tube, and the productivity can be further enhanced. And besides, the connection portion is prevented from striking against the other open end portion (that is, the other end) of the insulative tube, thus preventing the insulative tube from being damaged.

In the ninth aspect, there is provided the air injection step of blowing the air against the fused portion, formed by fusing the other open end portion of the insulative tube and the insulative sheaths of the plurality of wires together in the second fusing step, for the predetermined period of time, and there is further provided the pulling step of gripping the plurality of wires and the insulative tube after the air injection step and then pulling the plurality of wires and the insulative tube under the predetermined load relative to each other. Therefore, a check for checking whether or not the strength of fixing of the insulative tube and the plurality of wires to each other is sufficient can be carried out in continuous relation to the wire joint portion forming operation.

In the tenth aspect, in the connection portion forming step, there are used the pair of orderly-arranging guides which are opposed to each other in the horizontal direction and can be spaced from each other by the predetermined distance corresponding to the diameter of the wire so as to hold the plurality of wires therebetween to thereby arrange the plurality of wires in the column in the vertical direction. Therefore, the plurality of wires can be easily arranged in the column. Furthermore, the conductor portions of the plurality of wires arranged in the column by the pair of orderly-arranging guides are electrically connected together to form the connection portion. Therefore, the quality of the connection portion can be enhanced, and also the quality of the connection portion can be made stable. Furthermore, in the inserting step, the plurality of wires are arranged in the row in the direction perpendicular to the direction along which the pair of fusing members are opposed to each other to hold the insulative tube therebetween, and the connection portion of the plurality of wires is inserted into the insulative tube. Therefore, the fused portion formed by fusing the other open end portion of the insulative tube and the insulative sheaths of the plurality of wires together in the second fusing step can have a predetermined area, and the quality of the fused portion can be enhanced, and also the quality of the fused portion can be made stable.

In the eleventh aspect, there is provided the distal end correction step of correcting the connection portion in a misaligned condition into a straight condition before the inserting step. Therefore, the connection portion corrected into the straight condition can be positively inserted into the insulative tube, and the processing efficiency can be enhanced.

DESCRIPTION OF EMBODIMENTS (First Embodiment)

Figure 1:
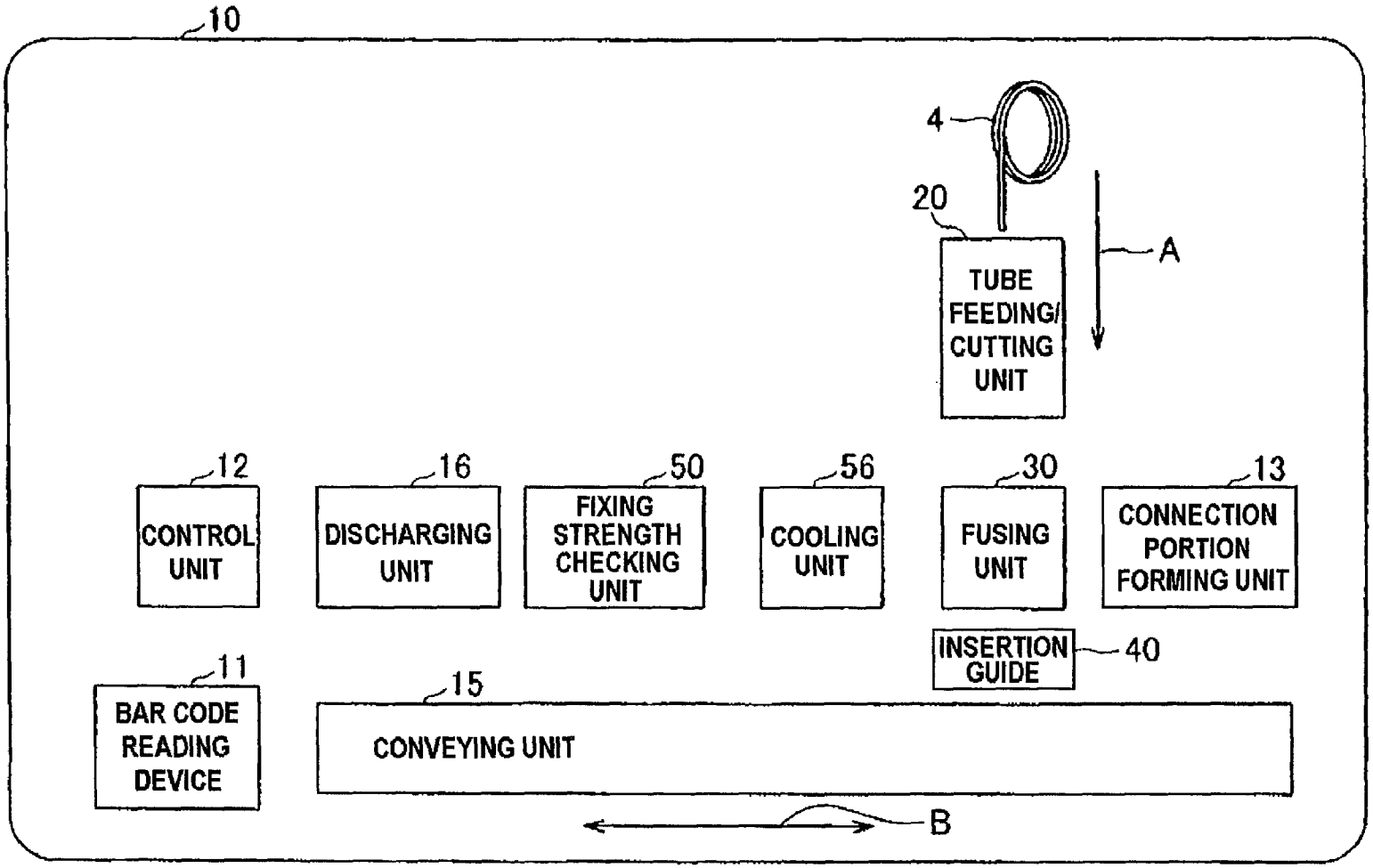
FIG. 1 is a block diagram showing a wire joint portion forming apparatus according to a first embodiment of the present invention.
Figure 2:
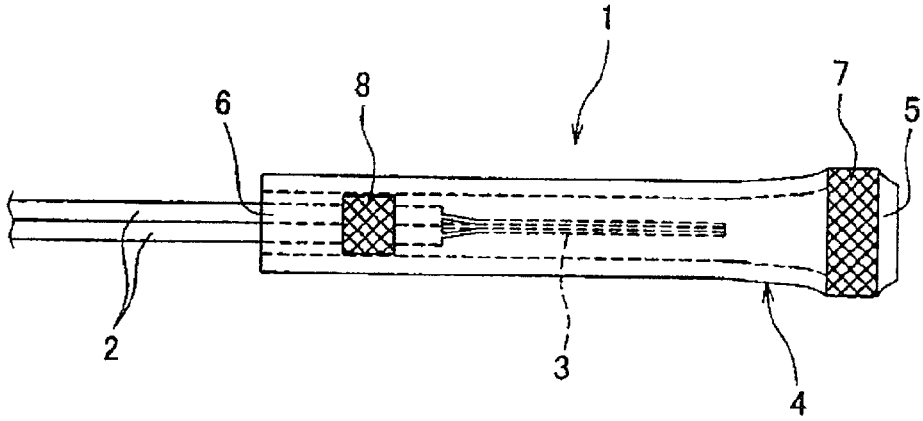
FIG. 2 is a plan view of a wire joint portion formed by the wire joint portion forming apparatus of FIG. 1.
Figure 3:
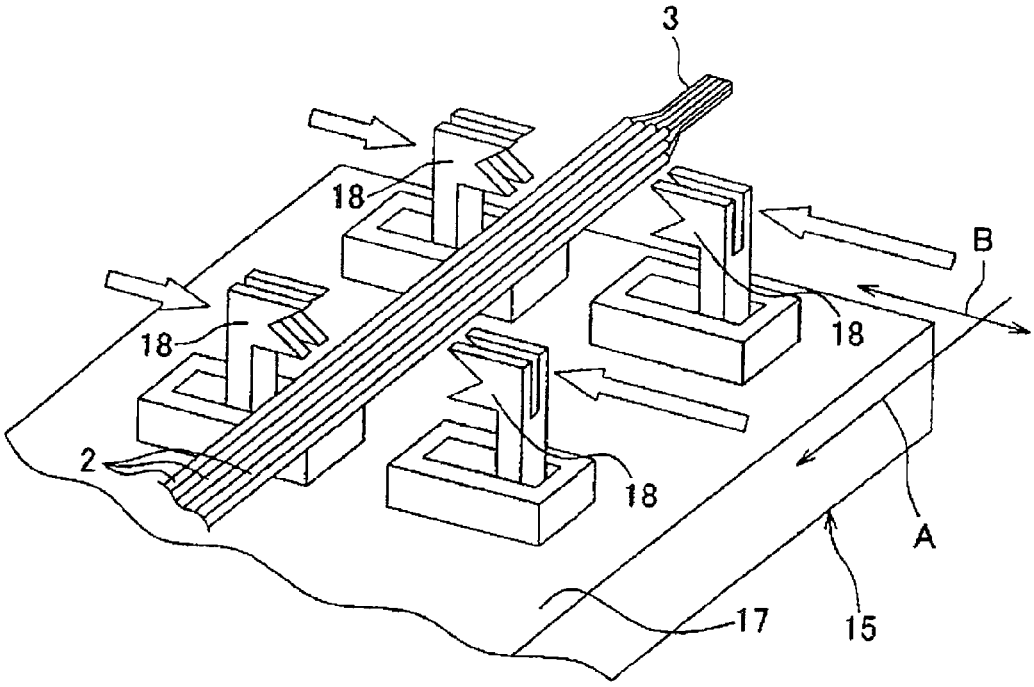
FIG. 3 is a perspective view of a conveying unit of the wire joint portion forming apparatus of FIG. 1.
Figure 4:
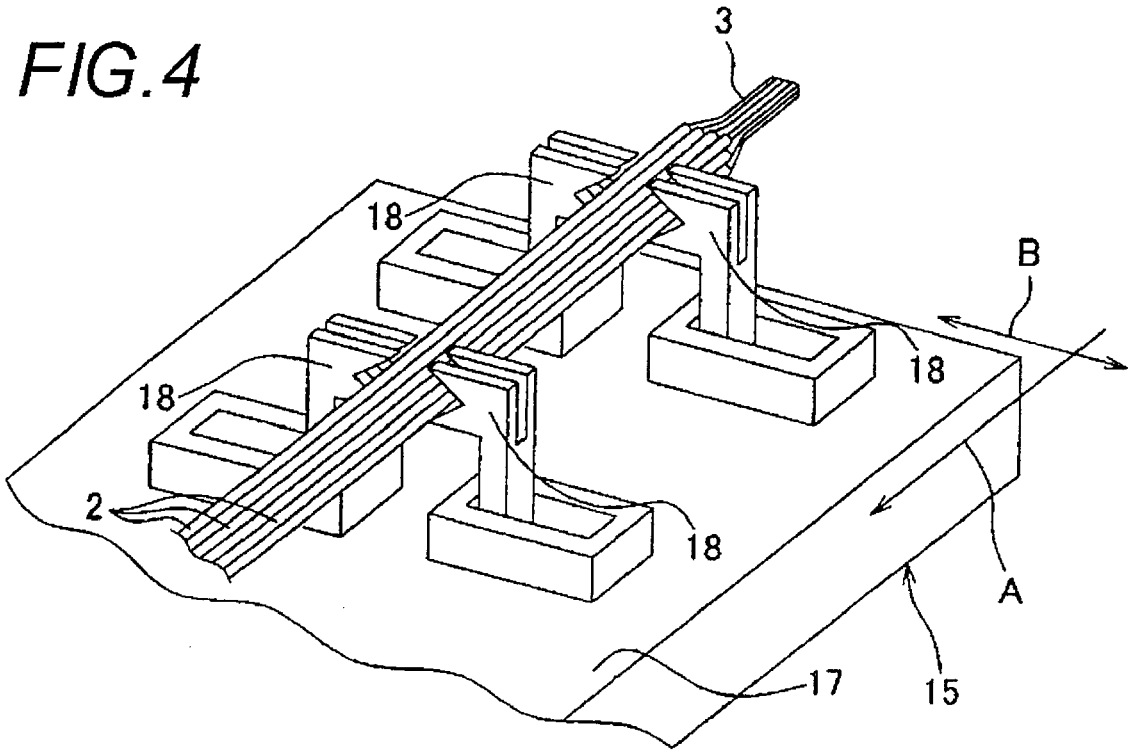
FIG. 4 is a perspective view showing a condition in which a plurality of wires are fixed by wire fixing arms of the conveying unit of FIG. 3.
Figure 5:
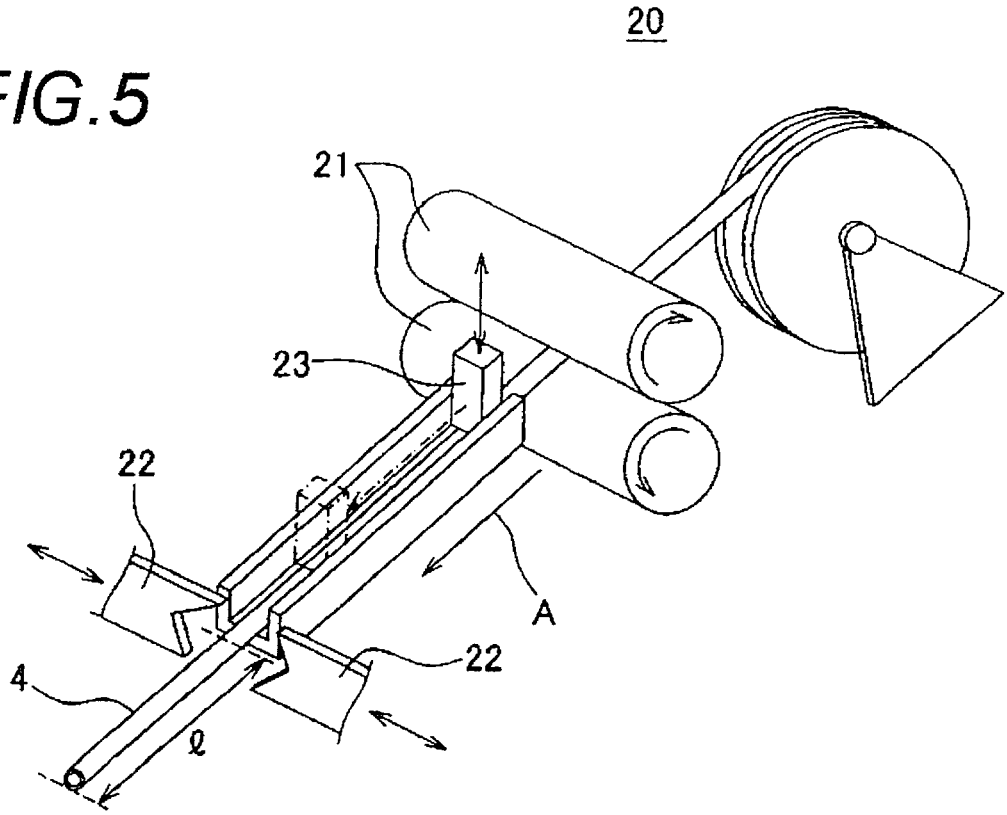
FIG. 5 is a schematic view of a tube feeding/cutting unit of the wire joint portion forming apparatus of FIG. 1.
Figure 6:
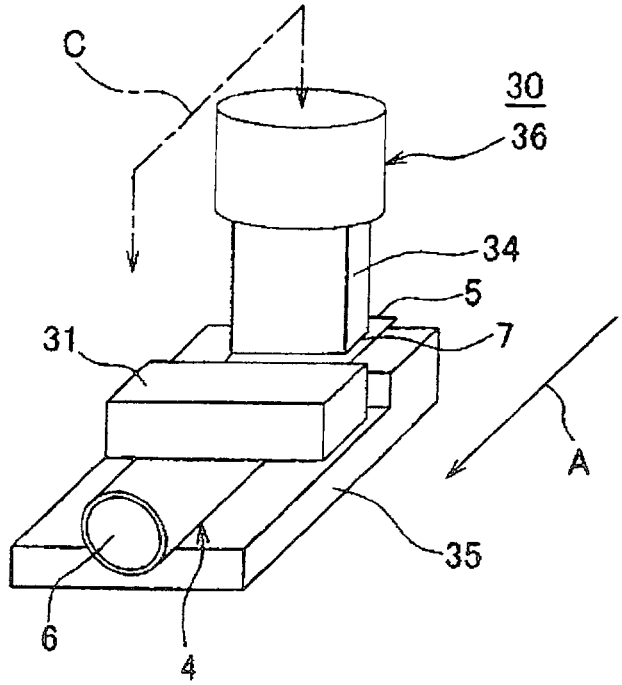
FIG. 6 is a perspective view of a fusing unit of the wire joint portion forming apparatus of FIG. 1, showing the manner of fusing one open end portion of an insulative tube by a horn and an anvil.
Figure 7:
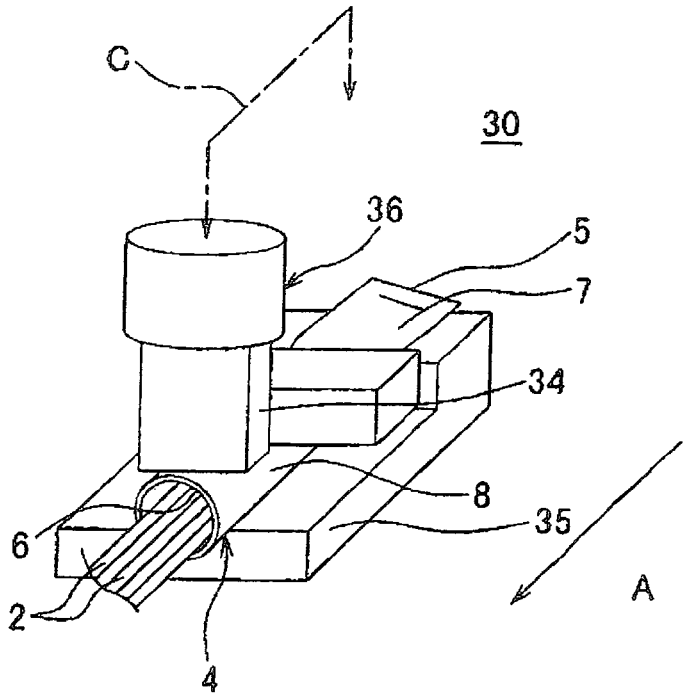
FIG. 7 shows the manner of fusing the other open end portion of the insulative tube and insulative sheaths of the plurality of wires together by the horn and anvil of the fusing unit of FIG. 6.
Figure 8:
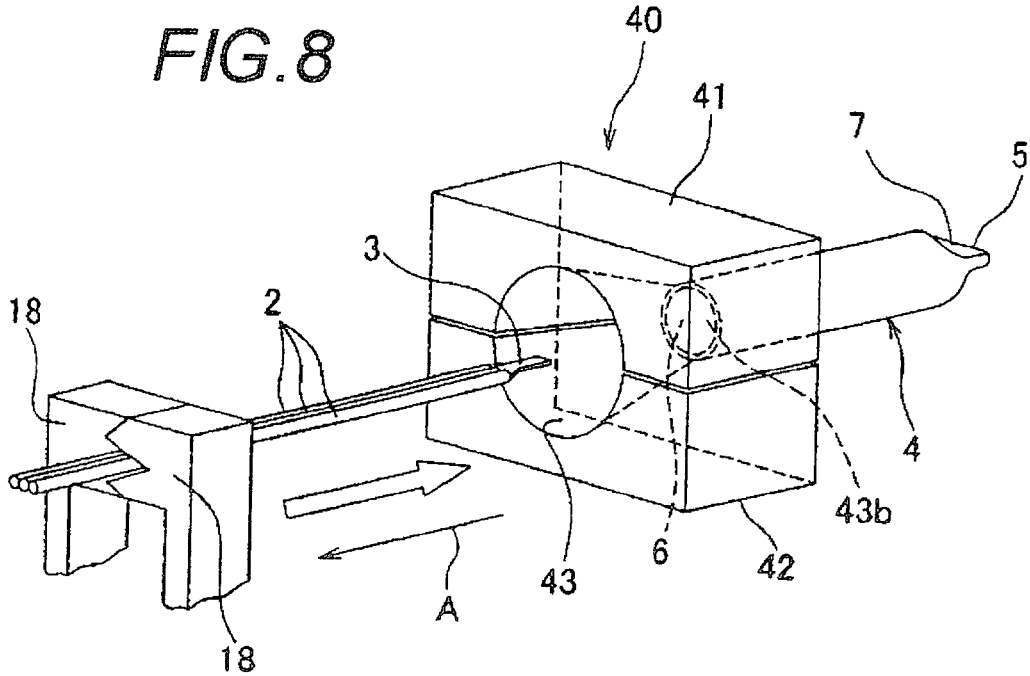
FIG. 8 is a perspective view of an insertion guide of the wire joint portion forming apparatus of FIG. 1.
Figure 9:
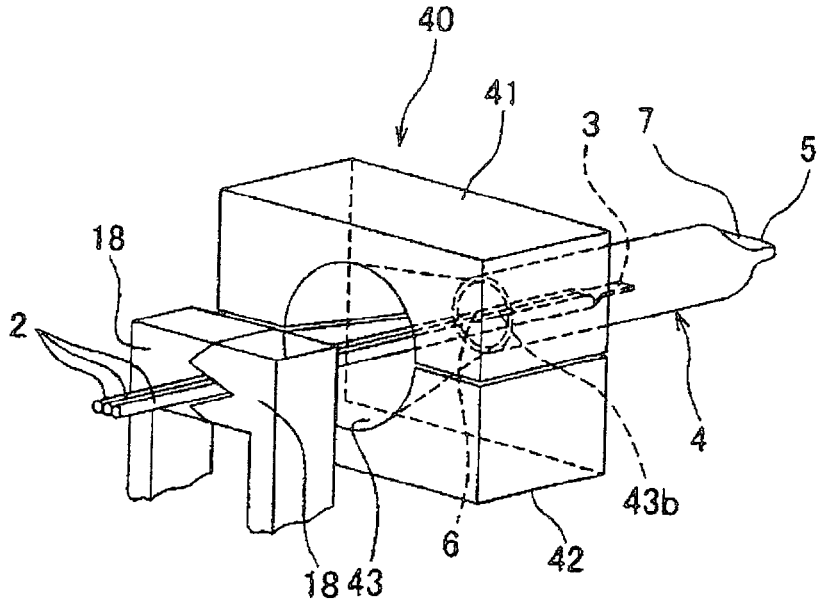
FIG. 9 is a perspective view showing a condition in which a connection portion of the plurality of wires is passed through the insertion guide of FIG. 8 and is inserted into a predetermined position within the insulative tube.
Figure 10:
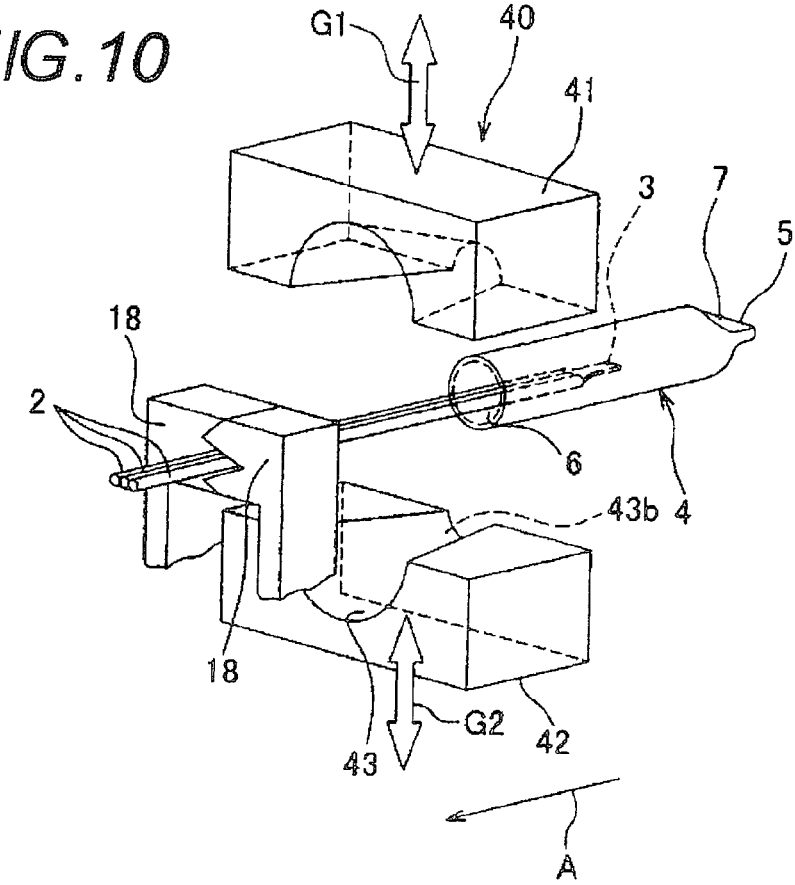
FIG. 10 is a perspective view showing a condition in which upper and lower dies of the insertion guide of FIG. 9 are moved apart from each other in an upward-downward direction.
Figure 11:
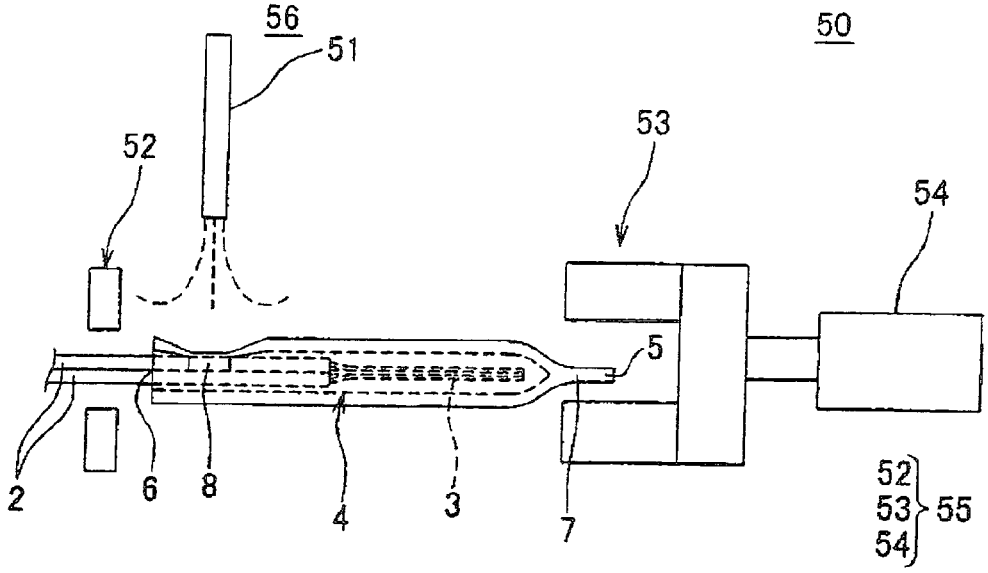
FIG. 11 is a plan view showing a condition in which an air injection nozzle of the wire joint portion forming apparatus of FIG. 1 blows the air against a fused portion formed by fusing the other open end portion of the insulative tube and the sheathes of the plurality of wires together.
Figure 12:
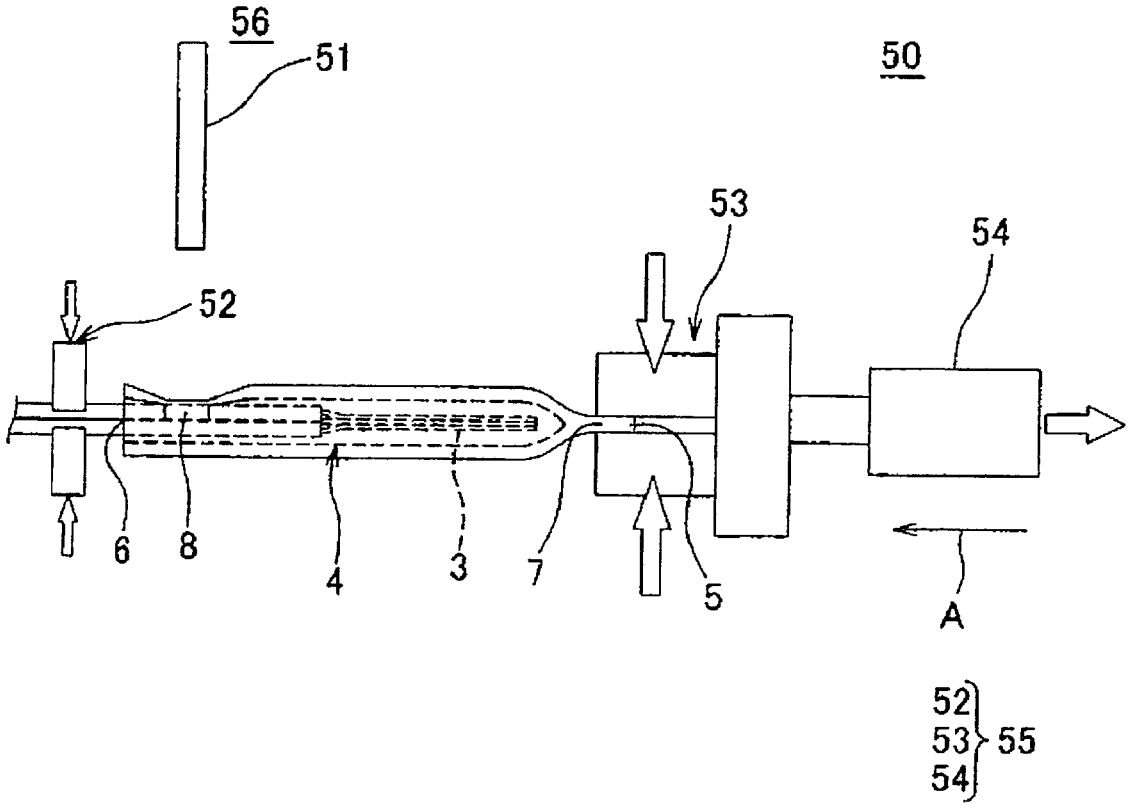
FIG. 12 is a plan view showing a condition in which the plurality of wires and the insulative tube are pulled relative to each other under a predetermined load by a pulling mechanism of the wire joint portion forming apparatus of FIG. 1.

A wire joint portion forming apparatus and a wire joint portion forming method according to a first embodiment of the present invention will now be described with reference to FIGS. 1 to 12. FIG. 1 is a block diagram of the wire joint portion forming apparatus of the first embodiment. FIG. 2 is a plan view of a wire joint portion formed by the wire joint portion forming apparatus of FIG. 1. FIG. 3 is a perspective view of a conveying unit of the wire joint portion forming apparatus of FIG. 1. FIG. 4 is a perspective view showing a condition in which a plurality of wires are fixed by wire fixing arms of the conveying unit of FIG. 3. FIG. 5 shows a tube feeding/cutting unit of the wire joint portion forming apparatus of FIG. 1. FIG. 6 is a perspective view of a fusing unit of the wire joint portion forming apparatus of FIG. 1, showing the manner of fusing one open end portion of an insulative tube by a horn and an anvil. FIG. 7 shows the manner of fusing the other open end portion of the insulative tube and insulative sheaths of the plurality of wires together by the horn and anvil of the fusing unit of FIG. 6. FIG. 8 is a perspective view of an insertion guide of the wire joint portion forming apparatus of FIG. 1. FIG. 9 is a perspective view showing a condition in which a connection portion of the plurality of wires is passed through the insertion guide of FIG. 8 and is inserted into a predetermined position within the insulative tube. FIG. 10 is a perspective view showing a condition in which upper and lower dies of the insertion guide of FIG. 9 are moved apart from each other in an upward-downward direction. FIG. 11 is a plan view showing a condition in which an air injection nozzle of the wire joint portion forming apparatus of FIG. 1 blows the air against a fused portion formed by fusing the other open end portion of the insulative tube and the sheathes of the plurality of wires together. FIG. 12 is a plan view showing a condition in which the plurality of wires and the insulative tube are pulled under a predetermined load by a pulling mechanism of the wire joint portion forming apparatus of FIG. 1.

A wire joint portion forming apparatus 10 according to a first embodiment of the present invention is an apparatus for forming a wire joint portion 1 (see FIG. 2) including a connection portion 3 (formed by electrically connecting conductor portions of end portions of a plurality of wires 2 together) and an insulative tube 4 covering the connection portion 3.

The wire 2 is a well-known wire including the conductor portion of an electrically-conductive nature and an insulative sheath covering the conductor portion. The insulative sheaths are removed or stripped respectively from the end portions of the wires 2, and exposed portions of the conductor portions at the end portions of the wires are electrically connected together to form the connection portion 3.

An elongated insulative tube (or tube stock) 4 made of an electrically-insulative material (such as vinyl chloride, polypropylene, elastomer and so on) and formed into a long cylindrical shape is cut into a predetermined length by the wire joint portion forming apparatus 10 to provide a cut-off insulative tube 4, and one open end portion 5 of the cut-off insulative tube 4 is fused to be closed or sealed, and the insulative tube 4 covers the connection portion 3 in such a manner that the other open end portion 6 of the insulative tube 4, that is, the open end portion remote from the one open end portion 5, is fused to the insulative sheaths of the plurality of wires 2. In FIG. 2, reference numerals 7 and 8 denote the schematically-shown fused portions. The insulative tube 4 covering the connection portion 3 ensures an electrical insulation of the connection portion 3.

As shown in FIG. 1, the wire joint portion forming apparatus 10 includes a bar code reading device (production information acquiring means) 11, a connection portion forming unit (connection portion forming means) 13, a tube feeding/cutting unit (tube feeding/cutting means) 20, a fusing unit (first fusing means, second fusing means) 30, a conveying unit (inserting means) 15, an insertion guide 40, a cooling unit 56, a fixing strength checking unit 50, a discharging unit (discharging means) 16, and a control unit (control means) 12. The control unit 12 is connected to the bar code reading device 11, the connection portion forming unit 13, the tube feeding/cutting unit 20, the fusing unit 30, the conveying unit 15, the insertion guide 40, the cooling unit 56, the fixing strength checking unit 50 and the discharging unit 16 so as to control the overall operation of the wire joint portion forming apparatus 10.

The bar code reading device 11 reads bar codes to acquire production information indicating part numbers (that is, sizes) of the wires 2 and insulative tube 4 and a product-producing number representative of the number of wire joint portions 1 to be formed (that is, the number of processings to be effected) (A production information acquiring step). Also, this production information is transmitted to the control unit 12. In this embodiment, although the bar code reading device 11 is used as the production information acquiring means, any other suitable means such as a well-known keyboard and a touch panel can be used as the production information acquiring means.

The connection portion forming unit 13 includes a fixing portion for fixing a plurality of wires 2, supplied from a wire supply unit (not shown) located outside the wire joint portion forming apparatus 10, in a bundled condition, and a connecting machine for electrically connecting conductor portions of these wires 2 together to form a connection portion 3 (A connection portion forming step). In this embodiment, a thermo-compression bonding machine is used as the connecting machine of the connection portion forming unit 13. However, in the invention, any other suitable connecting machine capable of electrically connecting the conductor portions of the wires 2 together, such as an ultrasonic welding machine, a terminal crimping machine, a terminal press-contacting machine and a solder dipping machine, can be used. The wire supply unit supplies a predetermined number of wires 2 of a predetermined part number to the connection portion forming unit 13 on the basis of the production information acquired by the bar code reading device 11. The wires 2 to be supplied to the connection portion forming unit 13 have their insulative sheaths beforehand removed from the end portions thereof.

As shown in FIG. 5, the tube feeding/cutting unit 20 includes a pair of feed rollers 21 for feeding the elongated insulative tube 4 of the predetermined part number, selected on the basis of the above production information and supplied thereto, in one-way direction 'A' parallel to an axis of the fed insulative tube 4, a cylinder 23 for holding the insulative tube 4, fed from the pair of feed rollers 21, from the upper side and then for being parallel moved in this condition in a predetermined amount in the one-way direction 'A' parallel to the axis of the insulative tube 4 to thereby feed the insulative tube 4, a pair of cutting blades 22 located downstream of the pair of feed rollers 21 and the cylinder 23 so as to cut the fed elongated insulative tube 4 into a predetermined length l, a plurality of pairs of rollers for feeding the cut-off insulative tube 4 toward the fusing unit 30, and so on. In this embodiment, although the tube setting step of inserting the elongated insulative tube 4 of the predetermined part number (selected on the basis of the production information) between the pair of feed rollers 21 to set the elongated insulative tube 4 in the tube feeding/cutting unit 20 is carried out by the worker, this tube setting operation can be automated by the use of a machine.

As shown in FIG. 1, the fusing unit 30 is located downstream of the tube feeding/cutting unit 20 in the one-way direction 'A' (that is, in the direction of feeding of the insulative tube 4), and is also located downstream of the connection portion forming unit 13 in a direction of arrow B. As shown in FIGS. 6 and 7, the fusing unit 30 includes a holder member 31 for holding an axially-central portion of the cut-off insulative tube 4 of the predetermined length l to fix it to the anvil 35 (serving as a fusing member), and an ultrasonic fusing machine 36 for applying a fusing treatment to the axially-opposite end portions of the fixed insulative tube 4 while each of these opposite end portions is held between the horn 34 (serving as a fusing member) and the anvil 35. In the ultrasonic fusing machine 36, the horn 34 is movable in a direction of arrow C between a position (FIG. 6) where the horn 34 is closer to the tube feeding/cutting unit 20 than the holder member 31 and a position (FIG. 7) where the horn 34 is remoter from the tube feeding/cutting unit 20 than the holder member 31. When the horn 34 is located in the position of FIG. 6, the ultrasonic fusing machine 36 fuses one open end portion 5 of the insulative tube 4 to close this open end portion 5 (A first fusing step). When the horn 34 is located in the position of FIG. 7, the ultrasonic fusing machine 36 fuses the other open end portion 6 of the insulative tube 4 and the insulative sheaths of the plurality of wires 2 together, thereby forming the wire joint portion 1 (A second fusing step).

In this embodiment, although the fusing unit 30 employs the ultrasonic fusing machine 36, any other suitable fusing machine capable of applying a fusing treatment to the opposite end portions of the insulative tube 4 can be used in the invention.

In the embodiment, thus, the other open end portion 6 of the insulative tube 4 and the insulative sheaths of the plurality of wires 2 are automatically fused together by the fusing unit 30 (that is, the second fusing means) under the control of the control unit 12, and therefore the productivity is enhanced as compared with the conventional construction in which the worker manually fastens the tongue portion 104 and the plurality of wires 101 together by the adhesive tape 111.

The conveying unit 15 includes a carriage 17 movable in the direction of arrow B (FIG. 1) and also in a direction perpendicular to the direction of arrow B, and the plurality of pairs of wire fixing arms 18 which extend upright from an upper surface of the carriage 17 and are movable in the direction of arrow B as shown in FIGS. 3 and 4. Each pair of wire fixing arms 18 hold the plurality of wires 2 therebetween to fix these wires 2. The conveying unit 15 moves or conveys the plurality of wires 2 in the direction of arrow B sequentially from the connection portion forming unit 13 to the fusing unit 30, from the fusing unit 15 to the cooling unit 56, from the cooling unit 56 to the fixing strength checking unit 50 and from the fixing strength checking unit 50 to the discharging unit 16. In a modified form of the embodiment, a chuck can be provided at the position where the fixing strength checking unit 50 is provided, in which case the wires 2 are conveyed to the cooling unit 56 by the conveying unit 15, and the wires 2 are passed from the conveying unit 15 to the chuck at that region between the cooling unit 56 and the fixing strength checking unit 50. With this construction, the time required for the production can be reduced.

The conveying unit 15 moves the plurality of wires 2 in the direction of arrow B from the connection portion forming unit 13 to the fusing unit 30, and then at the fusing unit 30, the conveying unit 15 moves the plurality of wires 2 in a direction perpendicular to the direction of arrow B, that is, in a direction opposite to the one-way direction 'A', thereby inserting the connection portion 3 into a predetermined position within the insulating tube 4 (whose one open end portion 5 is fusedly closed) through the other open end portion 6 thereof (An inserting step).

In the embodiment, thus, the connection portion 3 is automatically inserted by a predetermined amount into the insulative tube 4, that is, into the predetermined position within the insulative tube 4, by the conveying unit 15 (that is, the inserting means) controlled by the control unit 12. Therefore, the productivity is enhanced as compared with the conventional construction in which the worker manually inserts the connection portion 110 into the predetermined position within the tube body 102 while confirming the amount of insertion of the connection portion 110 into the tube body 102 with the eyes.

As shown in FIG. 1, the insertion guide 40 is located downstream of the fusing unit 30 in the one-way direction 'A'. The insertion guide 40 is located at such a position as to be facing the other open end portion 6 of the insulative tube 4 having the one open end portion 5 fused by the fusing unit 30. As shown in FIGS. 8 to 10, the insertion guide 40 has a through hole 43 of a generally conical shape formed through a central portion of a block-like body. Namely, the insertion guide 40 is formed into a tubular shape having inner diameter gradually decreasing from one end thereof remote from the other open end portion 6 of the insulative tube 4 toward the other end 43*b* thereof facing the other open end portion 6 of the insulative tube 4. The inner diameter of the other end 43*b* of the hole 43 opposed to the other open end portion 6 is smaller than the inner diameter of the other open end portion 6. The hole 43 of the insertion guide 40 is disposed coaxially with the insulative tube 4. The connection portion 3 of the plurality of wires 2 is passed through the hole 43 from the one end thereof to the other end thereof 43*b* so that the connection portion 3 is guided toward the other open end portion 6 of the insulative tube 4 by the insertion guide 40.

The insertion guide 40 is formed by two members, that is, the pair of upper and lower dies 41 and 42 arranged such that a center axis of the hole 43 is disposed between mated surfaces of the upper and lower dies 41 and 42. The upper die 41 and the lower die 42 are movable toward and away from each other, that is, in directions G1 and G2 (FIG. 10) perpendicular to the one-way direction 'A'. The upper and lower dies 41 and 42 are mated with (or abut against) each other (as shown in FIGS. 8 and 9) before the connection portion 3 is inserted into the insulative tube 4. After the connection portion 3 is inserted into the insulative tube 4, the upper and lower dies 41 and 42 are moved apart from each other (see FIG. 10). When the upper die 41 and the lower die 42 are thus moved apart from each other, the plurality of wires 2 having the insulative tube 2 fixed thereto can be moved or conveyed in the one-way direction 'A'.

In the embodiment, thus, there is provided the insertion guide 40, and therefore the connection portion 3 can be automatically positively inserted into the insulative tube 4 by the conveying unit 15, and therefore the productivity can be further enhanced. And besides, the connection portion 3 is prevented from striking against the other open end portion 6 (that is, the other end) of the insulative tube 4, thus preventing the insulative tube 4 from being damaged.

The cooling unit 56 is located downstream of the fusing unit 30 in the direction of arrow B. As shown in FIGS. 11 and 12, the cooling unit 56 includes an air injection nozzle (air injection means) 51 for blowing the air against a fused portion 8, formed by fusing the other open end portion 6 of the insulative tube 4 and the insulative sheaths of the plurality of wires 2 together by the fusing unit 30, for a predetermined period of time to cool this fused portion 8 (An air injection step).

In the embodiment, thus, the cooling unit 56 includes the air injection nozzle 51 for blowing the air against the fused portion 8 to cool the same, and therefore the time required for solidifying the fused portion 8, that is, for curing or setting the molten portions of the insulative sheaths and insulative tube 4, can be reduced, and therefore the productivity can be further enhanced. In the embodiment, the air injection nozzle 51 (that is, the air injection means) is not an essential element, and instead of providing the air injection nozzle 51, the time required for curing the fused portion 8, that is, the molten portions of the insulative sheaths and insulative tube 4, can be made longer.

The fixing strength checking unit 50 is located downstream of the cooling unit 56 in the direction of arrow B. As shown in FIGS. 11 and 12, the fixing strength checking unit 50 includes a pulling mechanism (pulling means) 55, and this pulling mechanism 55 includes a pair of chucks 52 and 53 for respectively gripping the plurality of wires 2 and the insulative tube 4 after finishing the blowing of the air by the air injection nozzle 51, and a load applying portion 54 for applying a predetermined load to the chuck 53 (which is one of the pair of chucks 52 and 53) to pull this chuck 53 in a direction away from the other chuck 52. The fixing strength checking unit 50 having the pulling mechanism 55 pulls the plurality of wires 2 and the insulative tube 4 relative to each other under the predetermined load (A pulling step) so as to check whether or not the strength of fixing of the insulative tube 4 and the plurality of wires 2 to each other is sufficient. Those products in which the insulative tube 4 is not separated from the plurality of wires 2 after the pulling test by the pulling mechanism 55 are judged as non-defective products, and the sufficient fixing strength is guaranteed for these products.

In the embodiment, thus, there is provided the fixing strength checking unit 50 (which is the simple equipment) associated with the facilities for forming the wire joint portion 1, and therefore the check for checking whether or not the strength of fixing of the insulative tube 4 and the plurality of wires 2 to each other is sufficient can be carried out in continuous relation to the wire joint portion forming operation. And besides, the facilities of the wire joint portion forming apparatus 10 can be simplified in construction.

In this embodiment, the pulling mechanism 55 is of such a construction that the predetermined load is applied only to the chuck 53 (which is one of the pair of chucks 52 and 53) so as to move this chuck 53 in the direction away from the other chuck 52. However, in the invention, the pulling mechanism 55 can be constructed such that the above load is applied to at least one of the pair of chucks 52 and 53 so as to move the pair of chucks 52 and 53 away from each other. Namely, the pulling mechanism 55 can be constructed such that the above load is applied only to the other chuck 52 or can be constructed such that the above load is applied to both of the two chucks 52 and 53.

The discharging unit 16 is located downstream of the fixing strength checking unit 50 in the direction of arrow B. Namely, the connection portion forming unit 13, the fusing unit 30, the cooling unit 56, the fixing strength checking unit 50 and the discharging unit 16 are arranged on a straight line in the direction of arrow B. The discharging unit 16 includes a plurality of feed rollers (not shown), and discharges the plurality of wires 2 having the proper wire joint portion 1 formed thereat (as the non-defective product), conveyed from the fixing strength checking unit 50, to the next step outside the wire joint portion forming apparatus 10. Also, the discharging unit 16 discharges the defective product (in which the insulative tube 4 has been separated from the plurality of wires 2 at the time of the examination conducted by the fixing strength checking unit 50) to a defective product recovery portion located outside the wire joint portion forming apparatus 10.

In the embodiment, thus, the tube feeding/cutting unit 20, the fusing unit 30 and the insertion guide 40 are arranged on a straight line in the one-way direction 'A' of feeding (conveying) of the insulative tube 4 by the tube feeding/cutting unit 20, and also the connection portion forming unit 13, the fusing unit 30, the cooling unit 56, the fixing strength checking unit 50 and the discharging unit 16 are arranged on the straight line in the direction of arrow B. Therefore, the structure of feeding (or conveying) the insulative tube 4 and the wires 2 between the adjacent devices (or units) can be simplified, and therefore the wire joint portion forming apparatus 10 can be formed into the space-saving and simple construction. And besides, the processing takt for forming the wire joint portion 1 can be shortened.

The control unit 12 is a computer including well-known RAM, ROM and CPU. The control unit 12 causes the connection portion forming unit 13, the tube feeding/cutting unit 20, the fusing unit 30, the conveying unit 15, the insertion guide 40, the cooling unit 56, the fixing strength checking unit 50 and the discharging unit 16 to be repeatedly operated on the basis of the product-producing number data (that is, the processing-effecting number data) contained in the production information acquired by the bar code reading device 11.

Next, the method of forming the wire joint portion 1 by the use of the wire joint portion forming apparatus 10 of the above construction will be described. First, production information indicating part numbers of wires 2 and insulative tube 4 is acquired by the bar code reading device 11 (The production information acquiring step). In accordance with this production information, the control unit 12 sends to the various devices (or units) instructions for effecting the predetermined operations. As a result, the wire supply unit supplies a predetermined number of wires 2 of the predetermined part number to the connection portion forming unit 13. In the connection portion forming unit 13, the plurality of wires 2 thus supplied are fixed together, and conductor portions of these wires 2 are electrically connected together to form a connection portion 3 (The connection portion forming step).

In accordance with the above production information, the worker inserts an elongated insulative tube 4 of the predetermined part number between the pair of feed rollers 21, thus setting the elongated insulative tube 4 in the tube feeding/cutting unit 20 (The tube setting step). The tube feeding/cutting unit 20 having the elongated insulative tube 4 set therein feeds this elongated insulative tube 4 in a predetermined amount and cuts the fed insulative tube 4 into a predetermined length (The tube feeding/cutting step). Then, the cut-off insulative tube 4 is fed to the fusion unit 30.

In the fusion unit 30, the holder member 31 holds an axially-central portion of the insulative tube 4 fed from the tube feeding/cutting unit 20, thereby fixing this insulative tube 4, and one open end portion 5 of the insulative tube 4 is fusedly closed by the ultrasonic fusing machine 36 (The first fusing step).

Then, the conveying unit 15 moves the plurality of wires 2 having the connection portion 3 formed thereat from the connection forming unit 13 to the fusing unit 30. At this time, the upper die 41 and the lower die 42 of the insertion guide 40 are abutted against each other, and the other end 43*b* of the hole 43 is disposed in facing relation to the other open end portion 6 of the insulative tube 4 fixed by the fixing portion of the fusing unit 30. The conveying unit 15 further moves the plurality of wires 2 by a predetermined amount in the direction opposite to the one-way direction 'A', so that the connection portion 3 is inserted into a predetermined position within the insulative tube 4 through the other open end portion 6 (The inserting step).

When the connection portion 3 is thus inserted into the insulative tube 4, the upper and lower dies 41 and 42 of the insertion guide 40 are moved away from each other. Then, the ultrasonic fusing machine 36 of the fusing unit 30 fuses the other open end portion 6 of the insulative tube 4 and insulative sheaths of the plurality of wires 2 to form a wire joint portion 1 (The second fusing step).

Then, the conveying unit 15 moves the plurality of wires 2 having the wire joint portion 1 formed thereat from the fusing unit 30 to the cooling unit 56. Then, the air injection nozzle 51 blows the air against a fused portion 8 of the wire joint portion 1 for a predetermined length of time to cool this fused portion 8 (The air injection step).

After the blowing of the air by the air injection nozzle 51 is finished, the conveying unit 15 moves the plurality of wires 2 having the wire joint portion 1 formed thereat from the cooling unit 56 to the fixing strength checking unit 50. Then, the pair of chucks 52 and 53 grip one end portion of the bundle of wires 2 and the one end portion of the insulative tube 4, respectively, and the load applying portion 54 is operated to pull the insulative tube 4 relative to the plurality of wires 2 under the predetermined load (The pulling step). After it is checked whether or not the strength of fixing of the insulative tube 4 and the plurality of wires 2 to each other is sufficient, the conveying unit 15 moves the plurality of wires 2 having the wire joint portion 1 formed thereat or the plurality of wires 2 and the insulative tube 3 separated from the wires 2 from the fixing strength checking unit 50 to the discharging unit 15.

The discharging unit 16 discharges the plurality of wires 2 having the wire joint portion 1 formed thereat (as the non-defective product) to the next step outside the wire joint portion forming apparatus 1. The discharging unit 16 discharges the plurality of wires 2 and the insulative tube 4 separated from the wires 2 (as the defective product) to the defective product recovery portion outside the wire joint portion forming apparatus 10.

When the plurality of wires 2 having the wire joint portion 1 formed thereat is thus discharged to the outside of the wire joint portion forming apparatus 10, the horn 34 of the ultrasonic fusing machine 36 is moved to the position (FIG. 6) where the horn 34 is closer to the tube feeding/cutting unit 20 than the holder member 31. Also, the upper and lower dies 41 and 42 of the insertion guide 40 are moved to abut against each other.

The above sequential processing is repeated in accordance with the product-producing number (that is, the processing-effecting number) indicated in the above production information, and thereafter the operation of the wire joint portion forming apparatus 10 is stopped. Thus, the required number of wire joint portions 1 determined by the product-producing number (that is, the processing-effecting number) indicated in the above production information are formed.

As described above, in the embodiment, the wire joint portion 1 in which the sufficient strength of fixing of the insulative tube 4 and the plurality of wires 2 to each other is guaranteed is formed by the wire joint portion forming apparatus 10 which is simple in construction and can achieve the excellent productivity.

In the above first embodiment, although the wire joint portion forming apparatus 10 includes the cooling unit 56, the fixing strength checking unit 50 and the insertion guide 40, the wire joint portion forming apparatus 10 of the invention does not always need to be provided with the cooing unit 56, the fixing strength checking unit 50 and the insertion guide 40.

(Second Embodiment)

Figure 13:
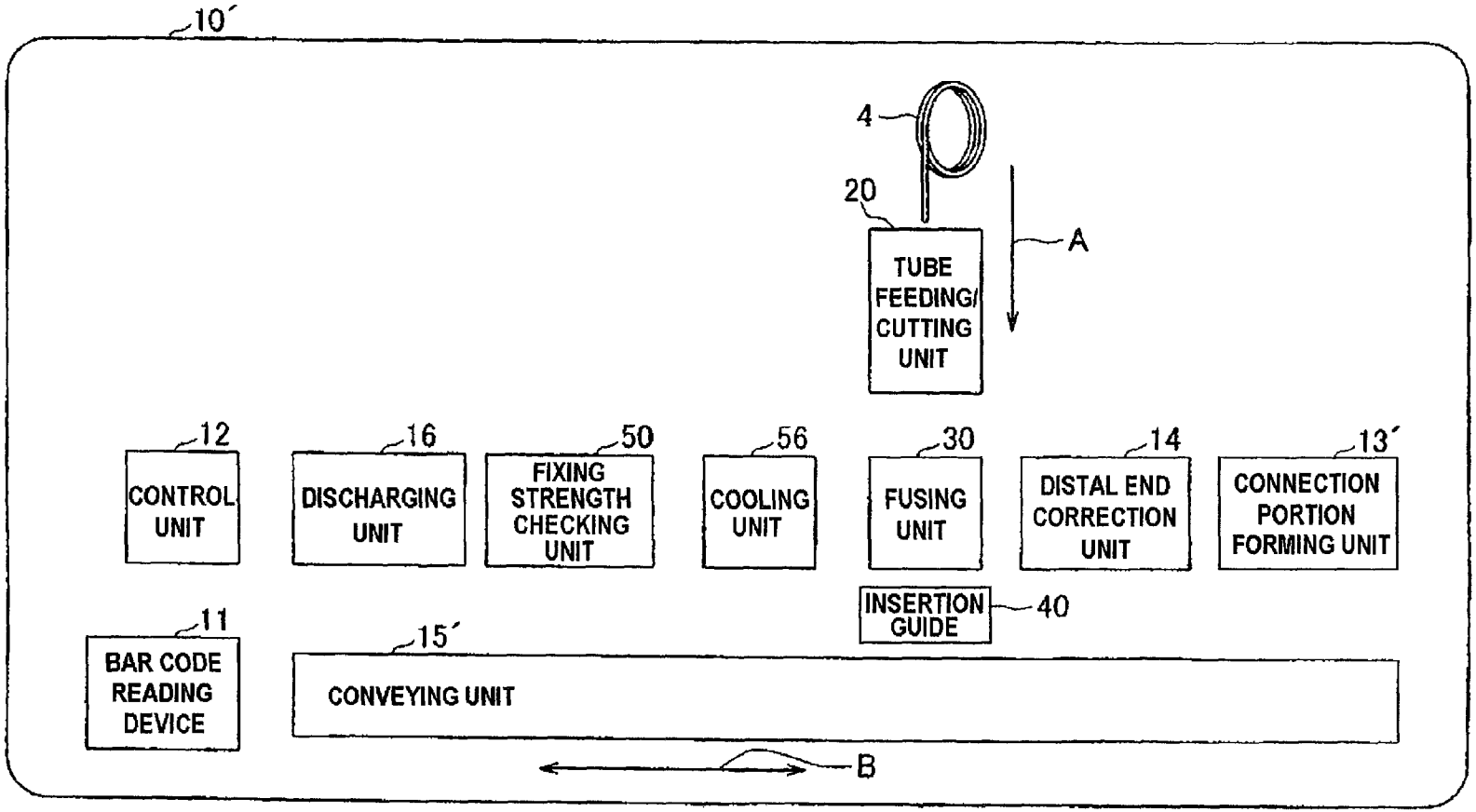
FIG. 13 is a block diagram of a second embodiment of a wire joint portion forming apparatus of the invention.
Figure 14:
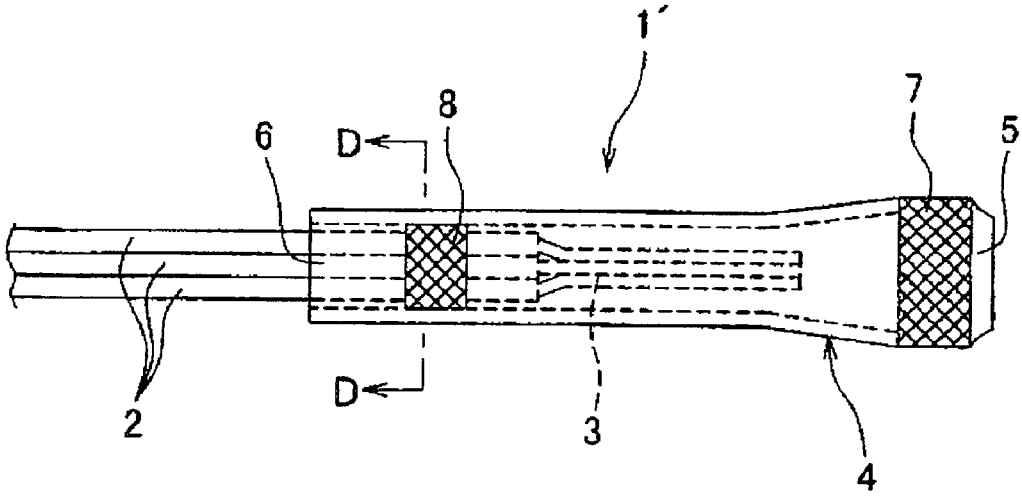
FIG. 14 is a plan view of a wire joint portion formed by the wire joint portion forming apparatus of FIG. 13.
Figure 15:
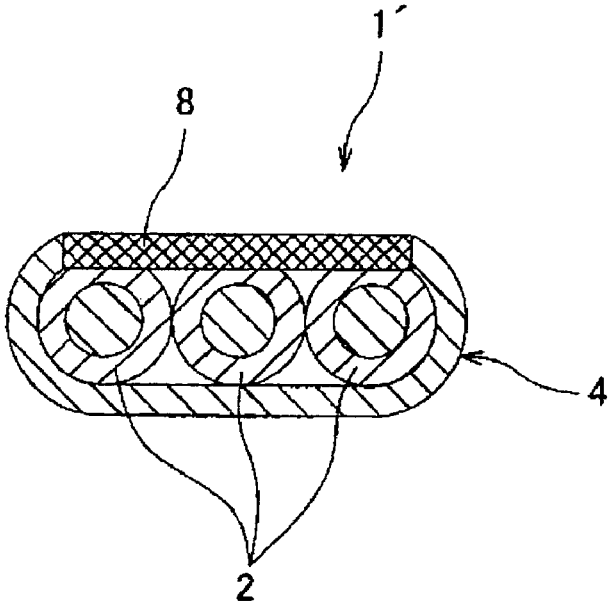
FIG. 15 is a cross-sectional view taken along the line D-D of FIG. 14.
Figure 16:
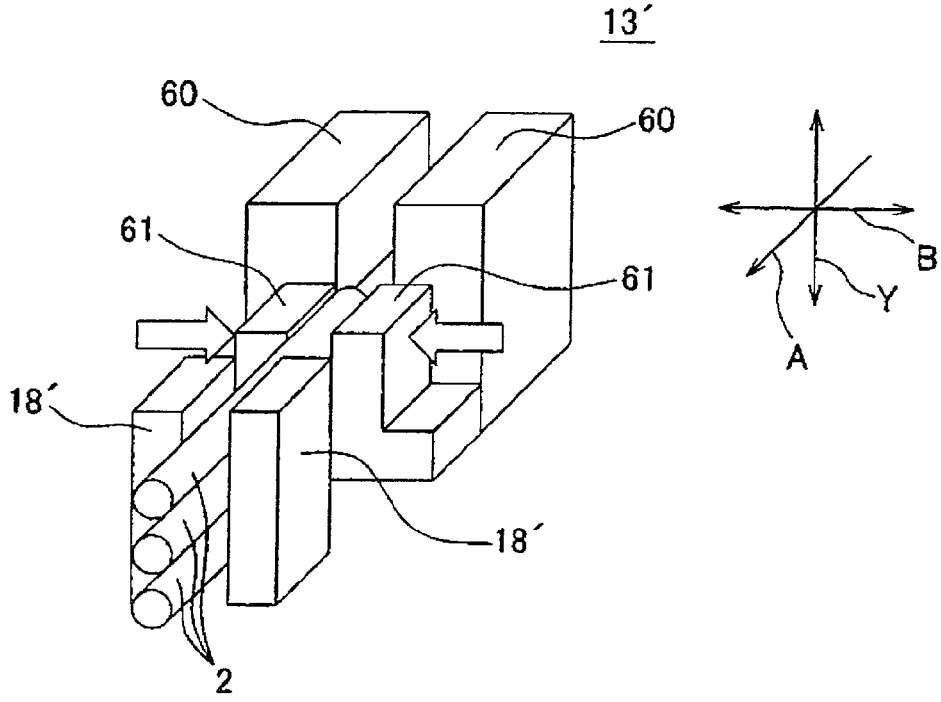
FIG. 16 is a view showing a connection portion forming unit of the wire joint portion forming apparatus of FIG. 13.
Figure 17:
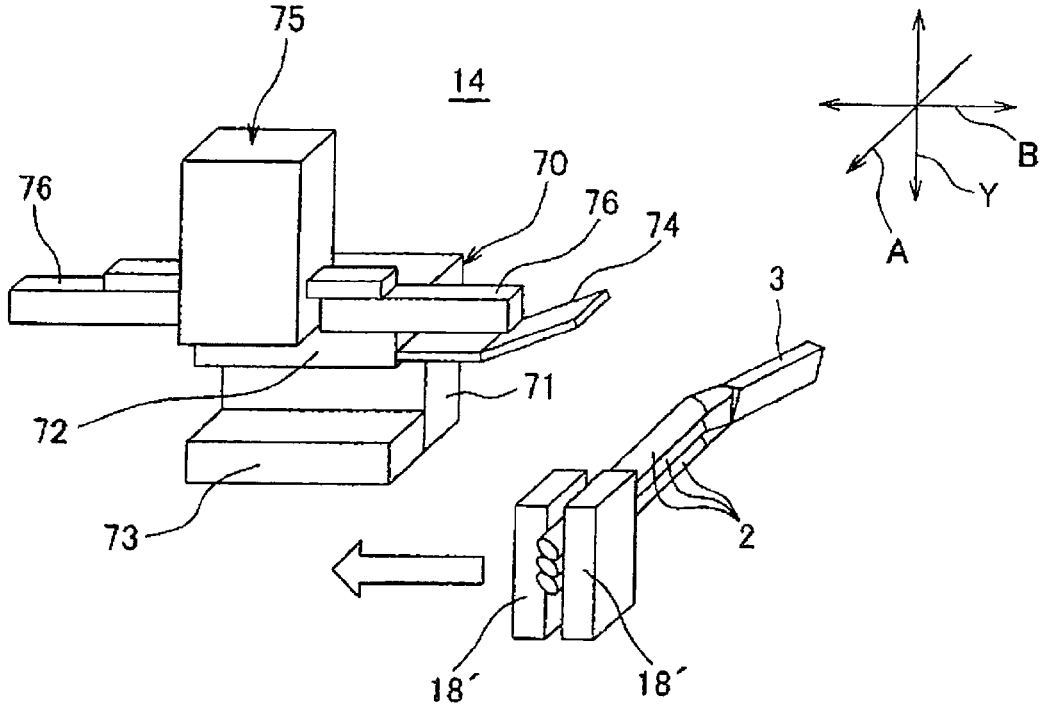
FIG. 17 shows a distal end correction unit of the wire joint portion forming apparatus of FIG. 13.
Figure 18:
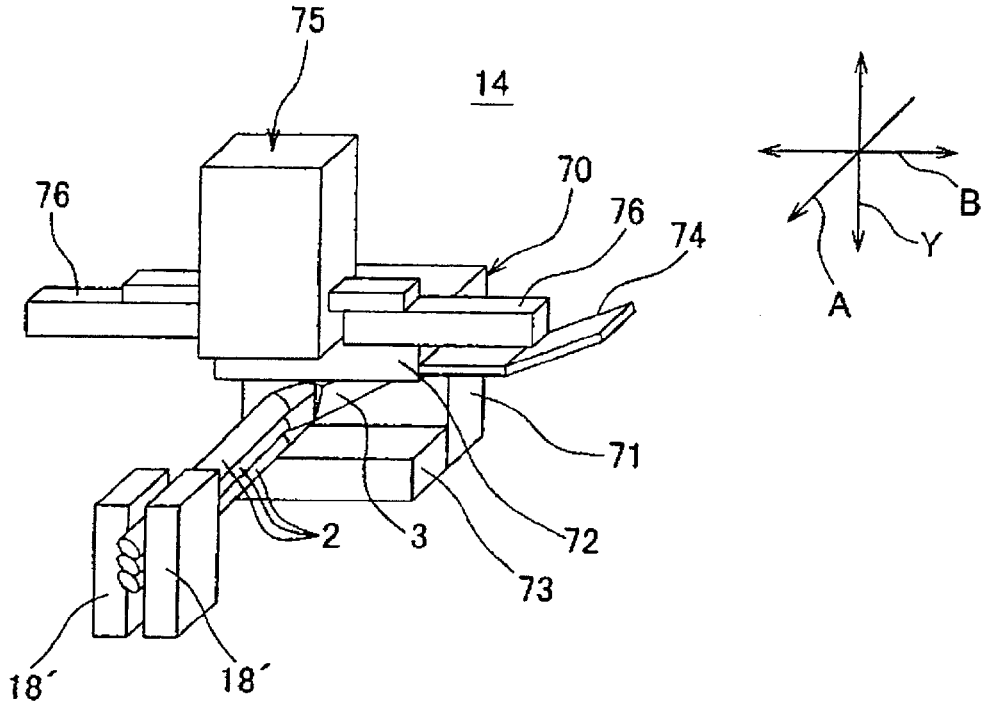
FIG. 18 shows a condition in which a plurality of wires having a connection portion formed thereat is conveyed to the distal end correction unit of FIG. 17.
Figure 19:
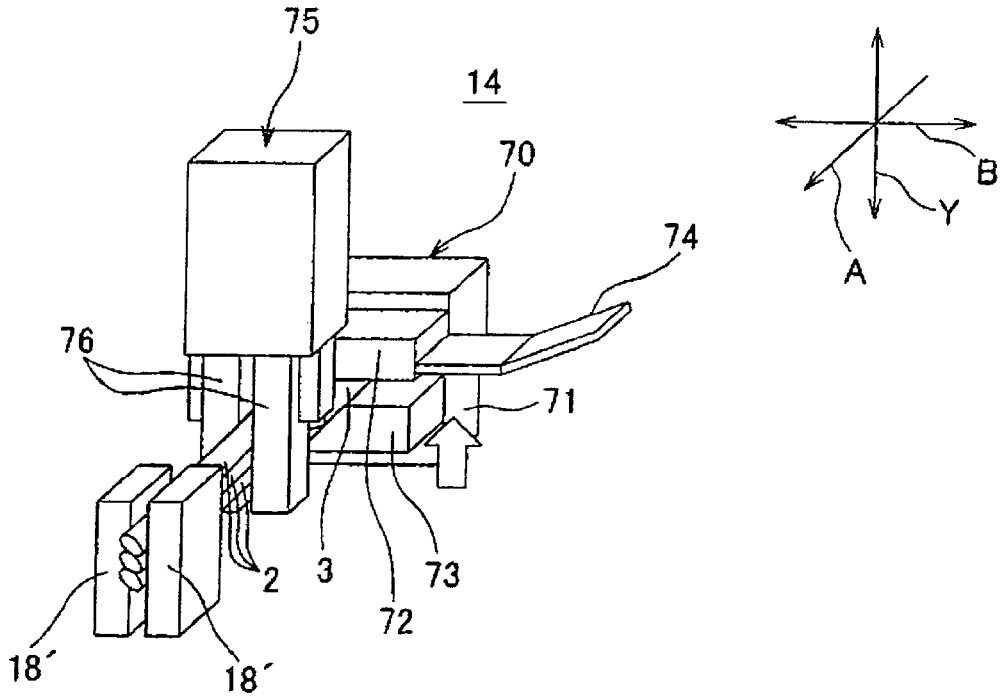
FIG. 19 shows a condition in which distal end correction chucks and proximal end correction chucks of the distal end correction unit of FIG. 18 are closed, and a misalignment of the plurality of wires having the connection portion formed thereat is in the process of being corrected.
Figure 20:
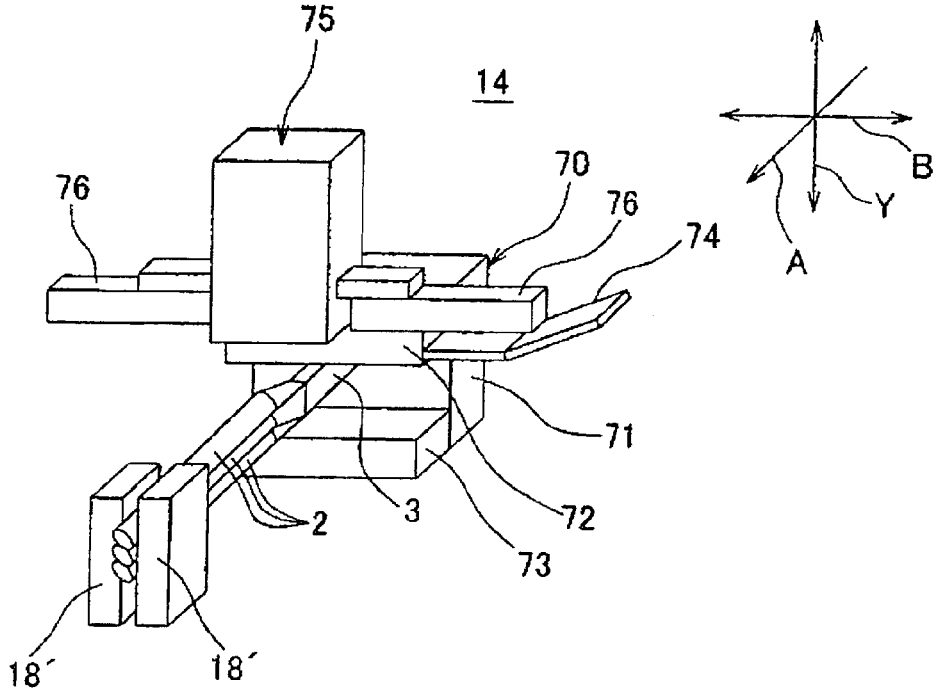
FIG. 20 shows a condition in which the distal end correction chucks and the proximal end correction chucks of the distal end correction unit shown in FIG. 19 are opened.
Figure 21:
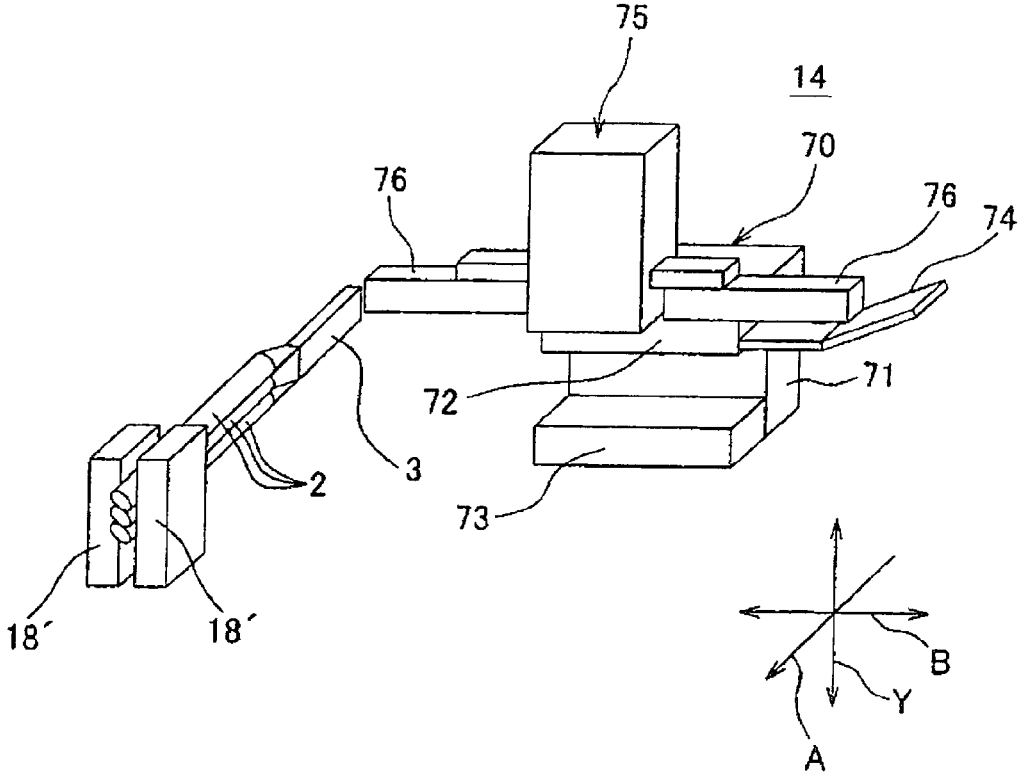
FIG. 21 shows a condition in which the plurality of wires whose misalignment has been corrected is fed out of the distal end correction unit.
Figure 22:
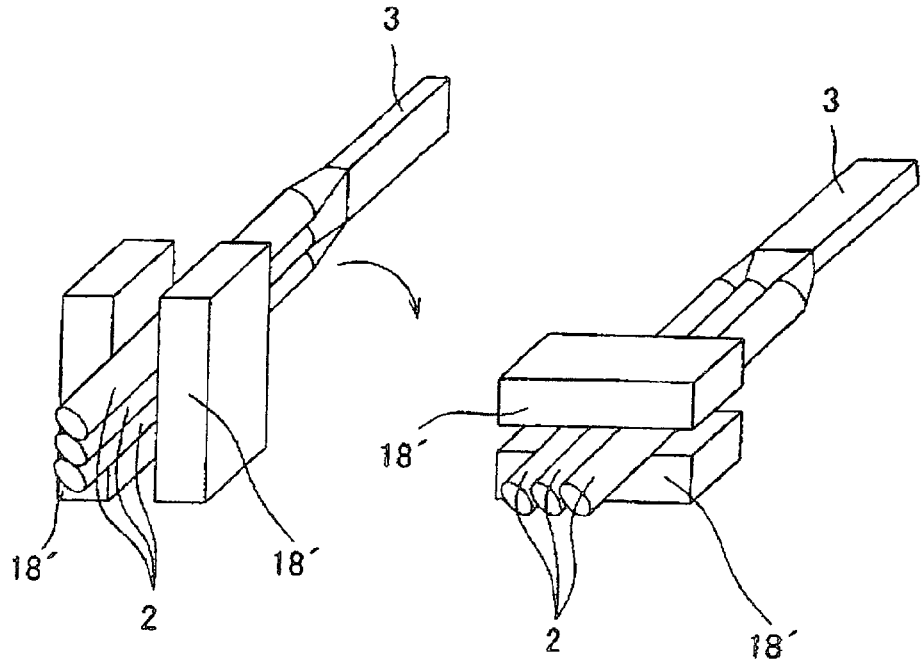
FIG. 22 is a view explanatory of an operation of wire fixing arms of a conveying unit of the wire joint portion forming apparatus of FIG. 13.
Figure 23:
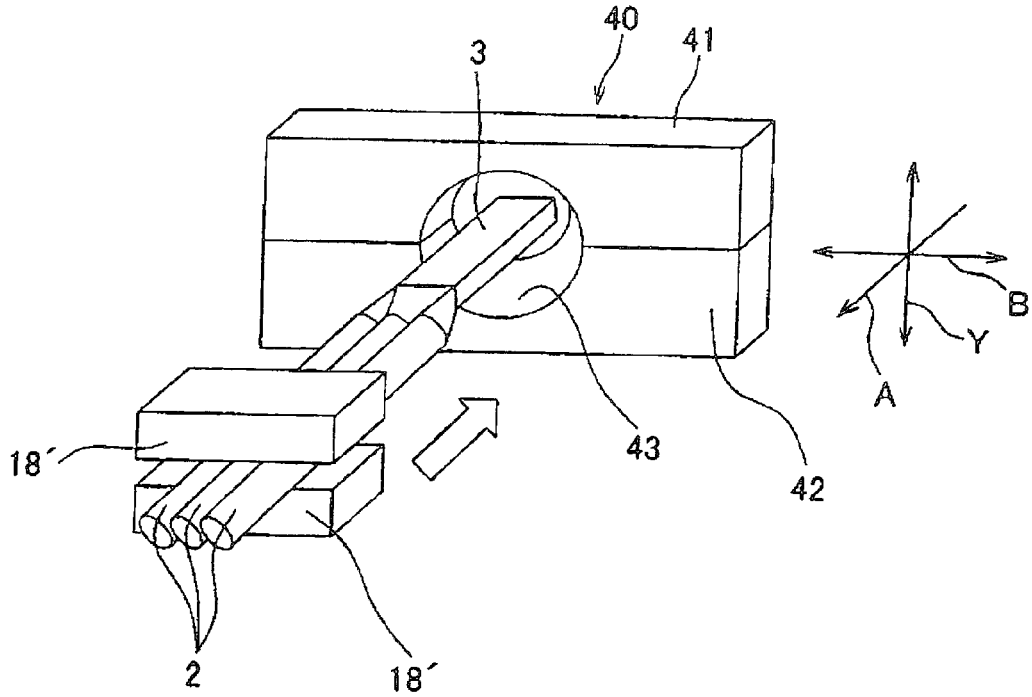
FIG. 23 shows a condition in which the plurality of wires whose misalignment has been corrected by the distal end correction unit of FIG. 21 is rotated through an angle of 90 degrees by the conveying unit of FIG. 22, and is passed through an insertion guide.
Figure 24:
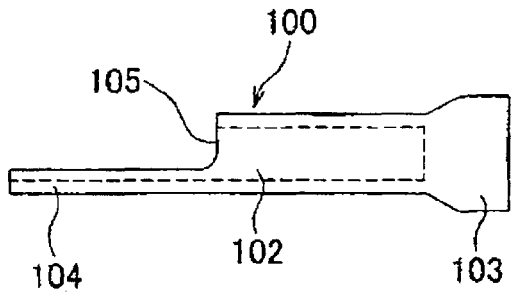
FIG. 24 is a plan view of a conventional insulative tube.
Figure 25:
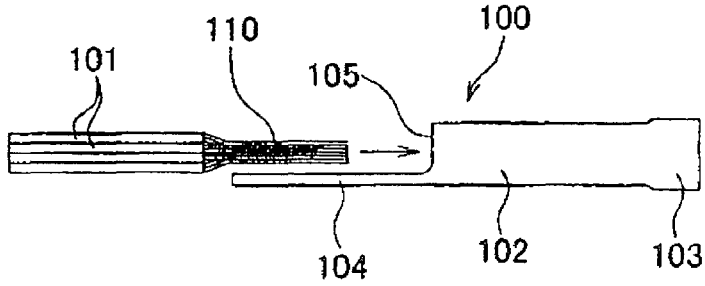
FIG. 25 is a plan view showing the manner of inserting a connection portion of a plurality of wires into the insulative tube of FIG. 24.
Figure 26:
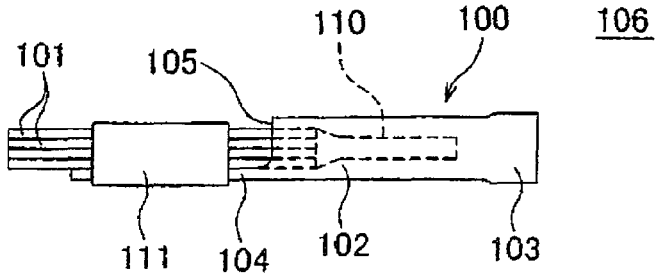
FIG. 26 is a plan view showing a condition in which the connection portion of the plurality of wires is inserted into the insulative tube of FIG. 24, and the insulative tube and the plurality of wires are fixed together by an adhesive tape.

Next, a wire joint portion forming apparatus and a wire joint portion forming method according to a second embodiment of the present invention will be described with reference to FIGS. 13 to 23. FIG. 13 is a block diagram of the wire joint portion forming apparatus of the second embodiment. FIG. 14 is a plan view of a wire joint portion formed by the wire joint portion forming apparatus of FIG. 13. FIG. 15 is a cross-sectional view taken along the line D-D of FIG. 14. FIG. 16 shows a connection portion forming unit of the wire joint portion forming apparatus of FIG. 13. FIG. 17 shows a distal end correction unit of the wire joint portion forming apparatus of FIG. 13. FIG. 18 shows a condition in which a plurality of wires having a connection portion formed thereat is conveyed to the distal end correction unit of FIG. 17. FIG. 19 shows a condition in which distal end correction chucks and proximal end correction chucks of the distal end correction unit of FIG. 18 are closed, and a misalignment of the plurality of wires having the connection portion formed thereat is in the process of being corrected. FIG. 20 shows a condition in which the distal end correction chucks and the proximal end correction chucks of the distal end correction unit shown in FIG. 19 are opened. FIG. 21 shows a condition in which the plurality of wires whose misalignment has been corrected is fed out of the distal end correction unit. FIG. 22 is an explanatory view of an operation of wire fixing arms of a conveying unit of the wire joint portion forming apparatus of FIG. 13. FIG. 23 shows a condition in which the plurality of wires whose misalignment has been corrected by the distal end correction unit of FIG. 21 is rotated through an angle of 90 degrees by the conveying unit of FIG. 22, and is passed through an insertion guide. In FIGS. 13 to 23, those portions identical in construction to the corresponding portions of the above first embodiment will be designated by identical reference numerals, respectively, and explanation thereof will be omitted.

The wire joint portion forming apparatus 10' according to the second embodiment of the present invention is an apparatus for forming a wire joint portion 1' (see FIGS. 14 and 15) including a connection portion 3 (formed by electrically connecting conductor portions of end portions of the plurality of wires 2 together) and an insulative tube 4 covering the connection portion 3. In this embodiment, although the wire joint portion 1' is composed of three wires 2, the wire joint portion 1' is not limited to this construction, and can be composed of two wires 2 or more than three wires 2.

As shown in FIG. 13, the wire joint portion forming apparatus 10' includes a bar code reading device (production information acquiring means) 11, a connection portion forming unit (connection portion forming means) 13', a distal end correction unit (distal end correction means) 14, a tube feeding/cutting unit (tube feeding/cutting means) 20, a fusing unit (first fusing means, second fusing means) 30, a conveying unit (inserting means) 15', an insertion guide 40, a cooling unit 56, a fixing strength checking unit 50, a discharging unit (discharging means) 16, and a control unit (control means) 12. The control unit 12 is connected to the bar code reading device 11, the connection portion forming unit 13', the distal end correction unit 14, the tube feeding/cutting unit 20, the fusing unit 30, the conveying unit 15', the insertion guide 40, the cooling unit 56, the fixing strength checking unit 50 and the discharging unit 16 so as to control the overall operation of the wire joint portion forming apparatus 10'.

As shown in FIG. 16, the connection portion forming unit 13' includes a pair of orderly-arranging guides 61 for holding the plurality of wires 2, supplied from a wire supply unit (not shown and located outside the wire joint portion forming apparatus 10'), therebetween to arrange these wires 2 in a column in a direction of arrow Y (that is, in a vertical direction) so as to fix these wires 2, and a connecting machine for electrically connecting the conductor portions of the plurality of wires 2, arranged in the column by the pair of orderly-arranging guides 61, together to form the connection portion 3 (A connection portion forming step).

The pair of orderly-arranging guides 61 are opposed to each other in a horizontal direction, that is, in a direction of arrow B. The pair of orderly-arranging guides 61 can be moved toward and away from each other in the direction of arrow B (that is, in the horizontal direction). More specifically, as shown in FIG. 16, the pair of orderly-arranging guides 61 can be moved toward each other into an operative position where the two orderly-arranging guides 61 is spaced from each other by a distance slightly larger than the diameter of each wire 2 (that is, by a predetermined distance corresponding to the diameter of the wire 2), and also can be moved away from each other into an inoperative position where the two orderly-arranging guides 61 is spaced from each other by a distance sufficiently larger than the above predetermined distance. When the pair of orderly-arranging guides 61 are moved toward each other, the distance therebetween is decreased, and when the pair of orderly-arranging guides 61 are moved away from each other, the distance therebetween is increased. When the pair of orderly-arranging guides 61 are disposed in the operative position where the two orderly-arranging guides 61 are spaced from each other by the distance slightly larger than the diameter of each wire 2 (that is, by the predetermined distance corresponding to the diameter of the wire 2), the plurality of wires 2 held between the pair of orderly-arranging guides 61 are arranged in a column in the direction of arrow Y (that is, in the vertical direction). The plurality of wires 2 thus arranged in the column by the pair of orderly-arranging guides 61 are held in intimate contact with one another in the vertical direction because of their own weight.

In the embodiment, thus, the pair of orderly-arranging guides 61 of the above construction are used, and therefore the plurality of wires 2 can be easily arranged in a column in the direction of arrow Y (that is, in the vertical direction).

The connecting machine is an ultrasonic connecting machine, and includes a pair of welding members 60 opposed to each other in the direction of arrow B (that is, in the horizontal direction) as shown in FIG. 16. The pair of welding members 60 hold the conductor portions of the plurality of wires 2, arranged in a column by the pair of orderly-arranging guides 61, therebetween and electrically connect these conductor portions together to form the connection portion 3.

In the embodiment, thus, the conductor portions of the plurality of wires 2 arranged in a column by the pair of orderly-arranging guides 61, are held between the pair of welding members 60, and are electrically connected together to form the connection portion 3. Therefore, the quality of the connection portion 3, that is, the reliability of electrical connection between the conductor portions, can be enhanced, and also the quality of the connection portion 3 can be made stable.

The plurality of wires 2 having the connection portion 3 formed by the connection portion forming unit 13' of the above construction is conveyed by the conveying unit 15' to the distal end correction unit 14 located downstream of the connection portion forming unit 13' in the direction of arrow B.

The distal end correction unit 14 is an apparatus for correcting a misaligned connection portion 3 of the plurality of wires 2 into a straight condition. The distal end correction unit 14 includes a distal end correction mechanism 70, a guide plate 74 and a proximal end correction mechanism 75, as shown in FIGS. 17 to 21.

The distal end correction mechanism 70 includes the pair of distal end correction chucks 72 and 73 which are opposed to each other in the direction of arrow Y (that is, in the vertical direction) and can be moved toward and away from each other in the direction of arrow Y, and a support portion 71 supporting the pair of distal end correction chucks 72 and 73. The pair of distal end correction chucks 72 and 73 are moved toward each other to grippingly hold a distal end portion of the connection portion 3 therebetween, thereby correcting a misalignment of the connection portion 3 in the upward-downward direction (that is, in the vertical direction).

The guide plate 74 is mounted on that end of the distal end correction chuck 72 disposed close to the connection portion forming unit 13'. This guide plate 74 has a plate-like shape, and is slanting such that the distance between the guide plate 74 and the other distal end correction chuck 73 in the direction of arrow Y is gradually decreasing toward the distal end correction unit 14, that is, away from the connection portion forming unit 13'. During the time when the connection portion 3 of the wires 2 is moved from the connection portion forming unit 13' to the distal end correction unit 14 by the conveying unit 15', the guide plate 74 guides the connection portion 3 into a space between the pair of distal end correction chucks 72 and 73. In the invention, another guide plate similar to the guide plate 74 can be mounted on the other distal end correction chuck 73.

The proximal end correction mechanism 75 includes the pair of proximal end correction chucks 76 pivotally movable between a position (FIG. 17) where the two proximal end correction chucks 76 are sufficiently spaced from each other and a position where (FIG. 19) where the two proximal end correction chucks 76 grippingly hold a proximal end portion of the connection portion 3 therebetween, and a support portion supporting the pair of proximal end correction chucks 76. The pair of proximal end correction chucks 76 are moved toward each other to grippingly hold the proximal end portion of the connection portion 3, thereby correcting a misalignment of the connection portion 3 in the right-left direction (that is, in the horizontal direction).

In the distal end correction unit 14, the pair of distal end correction chucks 72 and 73, as well as the pair of proximal end correction chucks 76, are sufficiently spaced from each other as shown in FIG. 17 before the connection portion 3 of the wires 2 is conveyed to the distal end correction unit 14. When the connection portion 3 of the wires 2 is located between the pair of distal end correction chucks 72 and 73 as shown in FIG. 18, the pair of distal end correction chucks 72 and 73, as well as the pair of proximal end correction chucks 76, are moved toward each other, so that the pair of distal end correction chucks 72 and 73 and the pair of proximal end correction chucks 76 grippingly hold the distal end portion and proximal end portion of the connection portion 3, respectively, to correct the misalignment of the connection portion 3 in all directions, thereby straightening the correction portion 3 (A distal end correction step). After the misalignment of the connection portion 3 is thus corrected, the pair of distal end correction chucks 72 and 73, as well as the pair of proximal end correction chucks 76, are moved away from each other as shown in FIG. 20, and the plurality of wires 2 having the connection portion 3 whose misalignment has been corrected is conveyed by the conveying unit 15' to the fusing unit 30 located downstream of the distal end correction unit 14 in the direction of arrow B, as shown in FIG. 21.

In the embodiment, thus, there is provided the distal end correction unit 14 which corrects the misaligned connection portion 3 of the plurality of wires 2 into a straight condition before this connection portion 3 is inserted into the insulative tube 4. Therefore, the connection portion 3 corrected into the straight condition can be positively inserted into the insulative tube 4, and the processing efficiency of the wire joint portion forming apparatus 10' can be enhanced. A misalignment does not always develop in the connection portion 3.

The conveying unit 15' includes a carriage 17 (see FIG. 3) as described above for the first embodiment, and a plurality of pairs of wire fixing arms 18' mounted on the carriage 17. Each pair of wire fixing arms 18' hold the plurality of wires 2 therebetween to fix these wires 2. As shown in FIG. 22, each pair of wire fixing arms 18' can be rotated or angularly moved between a position (FIG. 21) where the plurality of wires 2 held between each pair of wire fixing arms 18' are arranged in a column in the direction of arrow Y (that is, in the vertical direction) and a position (FIG. 23) where the plurality of wires 2 held between each pair of wire fixing arms 18' are arranged in a row in the direction of arrow B (that is, in the horizontal direction).

The plurality of wires 2 are moved by the conveying unit 15' of the above construction from the distal end correction unit 14 to the fusing unit 30 in the direction of arrow B, and then each pair of wire fixing arms 18' are angularly moved through an angle of 90 degrees from the position where the plurality of wires 2 held between each pair of wire fixing arms 18' are arranged in a column in the direction of arrow Y (that is, in the vertical direction) to the position where the plurality of wires 2 held between each pair of wire fixing arms 18' are arranged in a row in the direction of arrow B (that is, in the horizontal direction), as shown in FIG. 23. Then, the connection portion 3 of the plurality of wires 2 is inserted by the conveying unit 15' into the insulative tube 4 through the insertion guide 40 (An inserting step).

The insulative tube 4 having one open end portion 5 fusedly closed by the fusing unit 30 is held or clamped at its central portion by a holder member 31, so that the other open end portion 6 thereof is misaligned into a generally oval-shaped cross-section elongated in the direction of arrow B (that is, in the horizontal direction). Then, the conveying unit 15' inserts the connection portion 3 of the plurality of wires 2, arranged in a row in the direction of arrow B, into the insulative tube 4 (misaligned into the generally oval-shaped cross-section) through the other open end portion 6. Namely, in order that the connection portion 3 of the plurality of wires 2 can be positively inserted into the insulative tube 4, the plurality of pairs of wire fixing arms 18' of the conveying unit 15' are angularly moved, thereby arranging the plurality of wires 2 in a row so as to correspond to the cross-sectionally oval shape of the other open end portion 6 of the insulative tube 4.

Then, the connection portion 3 of the plurality of wires 2 (arranged in a row in the direction of arrow B perpendicular to the direction of Y along which a horn 34 (serving as a fusing member) and an anvil 35 (serving as a fusing member) of the fusing unit 30 are opposed to each other to hold the insulative tube 4 therebetween) is inserted into the insulative tube 4, and thereafter the horn 34 and the anvil 35 hold the other open end portion 6 of the insulative tube 4 therebetween, and fuse the other open end portion 6 and the insulative sheaths of the plurality of wires 2 together. Thus, the wire joint portion 1' shown in FIGS. 14 and 15 is formed. In the wire joint portion 1' shown in FIGS. 14 and 15, the insulative sheaths of all of the wires 2 are positively fused to the insulative tube 4 to form a fused portion 8, and this fused portion 8 has a relatively large area, and therefore the insulative tube 4 and all of the wires 2 are fused together and hence are fixed together with a sufficient fixing strength.

In the embodiment, thus, the plurality of wire fixing arms 18' of the conveying unit 15' arrange the plurality of wires 2 in a row in the direction of arrow B perpendicular to the direction of arrow Y along which the horn 34 and the anvil 35 are opposed to each other to hold the insulative tube 4 therebetween, and insert the connection portion 3 of the plurality of wires 2 into the insulative tube 4. Therefore, the fused portion 8 formed by fusing the other open end portion 6 of the insulative tube 4 and the insulative sheaths of the plurality of wires 2 together by the horn 34 and the anvil 35 can have a predetermined area, and the quality of the fused portion 8 can be enhanced, and also the quality of the fused portion 8 can be made stable.

The above embodiments merely show representative forms of the invention, and the present invention is not limited to these embodiments. Namely, various modifications can be made without departing from the subject matter of the invention.

The invention claimed is:

1. A forming apparatus for forming a wire joint portion including a connection portion and an insulative tube covering the connection portion, the forming apparatus comprising:

a production information acquiring unit which acquires production information indicating part numbers of wires and the insulative tube;

a connection portion forming unit which fixes a plurality of supplied wires selected on the basis of the production information, and then electrically connects conductor portions of the wires together to form the connection portion;

a tube feeding/cutting unit which feeds an elongated insulative tube, selected and supplied on the basis of the production information in a predetermined amount, and then cuts the elongated insulative tube into a predetermined length to provide the insulative tube in a cut-off condition;

a first fusing unit which fuses one open end portion of the insulative tube to close the one open end portion;

an inserting unit which moves the plurality of wires so as to insert the connection portion into a predetermined position within the insulative tube through the other open end portion of the insulative tube;

a second fusing unit which fuses the other open end portion of the insulative tube and insulative sheaths of the plurality of wires together so as to form the wire joint portion; and a discharging unit which discharges the plurality of wires having the wire joint portion formed thereat.

2. The forming apparatus according to claim 1, wherein the production information indicates a product-producing number representative of the number of the wire joint portions to be formed; and wherein the forming apparatus comprises a control unit which causes the connection portion forming unit, the tube feeding/cutting unit, the first fusing unit, the inserting unit, the second fusing unit and the discharging unit to be repeatedly operated on the basis of the product-producing number.

3. The forming apparatus according to claim 1, comprising an insertion guide which is located at a position to be facing the other open end portion of the insulative tube having the one open end portion fused by the first fusing unit, the insertion guide including a through hole having inner diameter gradually decreasing from one end thereof remote from the other open end portion of the insulative tube toward the other end thereof facing the other open end portion of the insulative tube, so as to pass the connection portion formed by the connection portion forming unit through the through hole from the one end of the through hole to the other end so that the connection portion is guided toward the other open end portion of the insulative tube by the insertion guide.

4. The forming apparatus according to claim 1, comprising:

an air injection unit which blows air against a fused portion formed by fusing the other open end portion of the insulative tube and the insulative sheaths of the plurality of wires together by the second fusing unit, for a predetermined period of time; and a pulling unit which includes: a pair of chucks for respectively gripping the plurality of wires and the insulative tube after finishing blowing of the air by the air injection unit; and a load applying portion which applies a predetermined load to at least one of the pair of chucks so as to pull the one chuck in a direction away from the other chuck.

5. The forming apparatus according to claim 1, wherein the connection portion forming unit includes: a pair of orderly-arranging guides which are opposed to each other in a horizontal direction and spaced from each other by a predetermined distance corresponding to a diameter of the wires so as to hold the plurality of wires therebetween to thereby arrange the plurality of wires in a column in a vertical direction; and a connecting machine which electrically connects the conductor portions of the plurality of wires, arranged in the column by the pair of orderly-arranging guides, together to form the connection portion, wherein the second fusing unit includes a pair of fusing members for holding the other open end portion of the insulative tube therebetween so as to fuse the other open end portion and the insulative sheaths of the plurality of wires together, and wherein the inserting unit arranges the plurality of wires in a row in a direction perpendicular to a direction along which the pair of fusing members are opposed to each other to hold the insulative tube therebetween, and inserts the connection portion of the plurality of wires into the insulative tube.

6. The forming apparatus according to claim 1, comprising a distal end correction unit which corrects the connection portion in a misaligned condition into a straight condition before the connection portion is inserted into the insulative tube.

7. A forming method of forming a wire joint portion including a connection portion and an insulative tube covering the connection portion, the forming method comprising:

a production information acquiring step of acquiring production information indicating part numbers of wires and the insulative tube;

a connection portion forming step of fixing a plurality of supplied wires selected on the basis of the production information and then electrically connecting conductor portions of the wires together to form the connection portion;

a tube setting step of setting an elongated insulative tube, having the part number indicated in the production information, in a tube feeding/cutting unit;

a tube feeding/cutting step of feeding the elongated insulative tube in a predetermined amount and then cutting the elongated insulative tube into a predetermined length by the use of the tube feeding/cutting unit to thereby provide the insulative tube in a cut-off condition;

a first fusing step of fusing one open end portion of the insulative tube to close the one open end portion;

an inserting step of moving the plurality of wires so as to insert the connection portion into a predetermined position within the insulative tube through the other open end portion of the insulative tube;

a second fusing step of fusing the other open end portion of the insulative tube and insulative sheaths of the plurality of wires together so as to form the wire joint portion; and a discharging step of discharging the plurality of wires having the wire joint portion formed thereat.

8. The forming method according to claim 7, wherein an insertion guide is used in the inserting step, and the insertion guide is located at a position to be facing the other open end portion of the insulative tube having the one open end portion fused in the first fusing step, the insertion guide including a through hole having inner diameter gradually decreasing from one end thereof remote from the other open end portion of the insulative tube toward the other end thereof facing the other open end portion of the insulative tube, so as to pass the connection portion formed in the connection portion forming step through the through hole of the insertion guide from the one end of the through hole to the other end so that the connection portion is guided toward the other open end portion of the insulative tube by the insertion guide.

9. The forming method according to claim 7, comprising:

an air injection step of blowing air against a fused portion, formed by fusing the other open end portion of the insulative tube and the insulative sheaths of the plurality of wires together in the second fusing step, for a predetermined period of time; and a pulling step of gripping the plurality of wires and the insulative tube after the air injection step, and then pulling the plurality of wires and the insulative tube under a predetermined load relative to each other.

10. The forming method according to claim 7, wherein in the connection portion forming step, there are used a pair of orderly-arranging guides which are opposed to each other in a horizontal direction and spaced from each other by a predetermined distance corresponding to a diameter of the wire so as to hold the plurality of wires therebetween to thereby arrange the plurality of wires in a column in a vertical direction, and the conductor portions of the plurality of wires arranged in the column by the pair of orderly-arranging guides are electrically connected together to form the connection portion; and in the second fusing step, there are used a pair of fusing members for holding the other open end portion of the insulative tube therebetween so as to fuse the other open end portion and the insulative sheaths of the plurality of wires together; and in the inserting step, the plurality of wires are arranged in a row in a direction perpendicular to a direction along which the pair of fusing members are opposed to each other to hold the insulative tube therebetween, and the connection portion of the plurality of wires is inserted into the insulative tube.

11. The forming method according to claim 7, comprising a distal end correction step of correcting the connection portion in a misaligned condition into a straight condition before the inserting step.

* * * * *